US010533335B2

(12) United States Patent
Maggeni et al.

(10) Patent No.: US 10,533,335 B2
(45) Date of Patent: Jan. 14, 2020

(54) AUTONOMOUS POOL CLEANING ROBOT

(71) Applicant: MAYTRONICS LTD., Kibutz, Yizrael (IL)

(72) Inventors: Yohanan Maggeni, Ilaniya (IL); Shay Witelson, Yizrael (IL)

(73) Assignee: Maytronics Ltd., Kibbutz, Yizrael (IL)

( * ) Notice: Subject to any disclaimer, the term of this patent is extended or adjusted under 35 U.S.C. 154(b) by 628 days.

(21) Appl. No.: 15/089,606

(22) Filed: Apr. 4, 2016

(65) Prior Publication Data

US 2016/0289988 A1 Oct. 6, 2016

Related U.S. Application Data

(63) Continuation-in-part of application No. 14/501,098, filed on Sep. 30, 2014, now Pat. No. 9,920,545.

(60) Provisional application No. 62/146,335, filed on Apr. 12, 2015, provisional application No. 61/890,260, filed on Oct. 13, 2013.

(51) Int. Cl.
*E04H 4/16* (2006.01)

(52) U.S. Cl.
CPC ..... *E04H 4/1654* (2013.01)

(58) Field of Classification Search
CPC . E04H 4/1654; E04H 4/16; A47L 1/02; A47L 2201/00; B60P 1/04
USPC ..... 15/1.7
See application file for complete search history.

(56) References Cited

U.S. PATENT DOCUMENTS

| | | | | |
|---|---|---|---|---|
| 3,344,454 | A * | 10/1967 | Mikalson | A47L 1/02 15/50.3 |
| 8,661,595 | B2 | 5/2014 | Bernini | |
| 2004/0211450 | A1 * | 10/2004 | Stoltz | E04H 4/1654 134/166 R |
| 2009/0057238 | A1 | 3/2009 | Garti | |
| 2010/0307545 | A1 * | 12/2010 | Osaka | B08B 3/024 134/198 |
| 2013/0104321 | A1 | 5/2013 | Michaleon | |
| 2013/0341284 | A1 * | 12/2013 | Michelon | E04H 4/16 210/739 |

FOREIGN PATENT DOCUMENTS

| | | | | |
|---|---|---|---|---|
| CN | 105962858 A * | 9/2016 | | |
| WO | WO 2016026059 A1 * | 2/2016 | | E04H 4/14 |

* cited by examiner

*Primary Examiner* — Sean K. Hunter
*Assistant Examiner* — Aaron R McConnell
(74) *Attorney, Agent, or Firm* — Reches Patents

(57) ABSTRACT

A pool cleaning robot for cleaning a pool, that may include a housing; a first interfacing element is configured to interface between the pool cleaning robot and a bottom of a pool while the pool cleaning robot cleans the bottom of the pool; and one or more second interfacing elements that are configured to reduce a friction between the pool and the pool cleaning robot during at least a portion of an exit process in which the pool cleaning robot exits the pool.

22 Claims, 27 Drawing Sheets

AUTONOMOUS POOL CLEANING ROBOT

RELATED APPLICATIONS

This application claims priority from U.S. provisional patent Ser. No. 62/146,335 filing date Apr. 12, 2015 and is a continuation in part of U.S. patent application Ser. No. 14/501,098 filing date Sep. 30, 2014 which claims priority from U.S. provisional patent Ser. No. 61/890,260 filing date Oct. 13, 2013, all being incorporated herein by reference.

BACKGROUND

There is a growing need to reduce the human intervention in cleaning pools. It is well known that pool cleaning robot usually need to be immerged or retrieved manually from or into a swimming pool. Retrieval may be performed by grabbing and pulling the electrical cable followed by grabbing and pulling of a handle or retrieving by means of a special pike with a hook. Immersion can be performed by grabbing and lifting the cleaner by its handle and immersing it manually into the water. These are time consuming operations, difficult at times. The intention of this invention is to specifically facilitate the retrieval of the pool cleaning robot making it an automatic function. It may also generally intend to improve on the basic rule which govern the method of pool cleaning robot handling by introducing an almost fully automatic and autonomous pool cleaning robot which seldom needs any manual intervention.

SUMMARY

According to an embodiment of the invention there may be provided a pool cleaning robot for cleaning a pool, the pool cleaning robot may include a housing; a first interfacing element may be configured to interface between the pool cleaning robot and a bottom of a pool while the pool cleaning robot cleans the bottom of the pool; and one or more second interfacing elements that may be configured to reduce a friction between the pool and the pool cleaning robot during at least a portion of an exit process in which the pool cleaning robot exits the pool.

The one or more second interfacing elements may include at least one radially symmetrical rotating element.

A given second interface of the one or more second interfacing elements may be configured not to contact the bottom of the pool when the pool cleaning robot cleans the bottom of the pool.

The one or more second interfacing elements may include at least one radially symmetrical rotating element.

The one or more second interfacing elements may include a radially symmetrical rotating element that may be coupled to an intermediate element, wherein the intermediate element may be configured to move between a first position to a second position thereby changing a spatial relationship between the housing and the radially symmetrical rotating element. The movement of the intermediate element can include a movement to any intermediate position between the first and second positions.

The pool cleaning robot may include an interface manipulator that may be configured to move the intermediate element between the first position to the second position.

The intermediate element may be rotatably coupled to the housing.

The intermediate element may be rotatably coupled to the housing by a handle that has an axis of rotation that virtually intersects with a front upper part of the housing.

The radially symmetrical rotating element may be configured to protrude from the intermediate element during the portion of the exit process.

The pool cleaning robot according to claim wherein the radially symmetrical rotating element may be configured not to protrude from the intermediate element when the pool cleaning robot cleans the pool.

The pool cleaning robot may include a sensor and a controller; wherein the controller may be configured to trigger a movement of the intermediate element between the first position and the second position based on signals sent from the sensor.

The sensor may be a height sensor.

The sensor may be an out of water sensor that may be configured to sense that at least a portion of the pool cleaning robot exits a water of the pool.

The pool cleaning robot may include a controller; wherein the controller may be configured to trigger a movement of the intermediate element between the first position and the second position based on signals sent from an external system that may include an external sensor that may be configured to assist in an extraction of the pool cleaning robot from the pool.

An intermediate element may be mechanically coupled to an external system that may be configured to assist in an extraction of the pool cleaning robot from the pool; wherein the pool cleaning robot may be configured to perform the movement of the intermediate element between the first position and the second position based on a command from the system.

An intermediate element may be mechanically coupled to the external system via a cable; and wherein the movement of the intermediate element between the first position and the second position may be responsive to a tension of the cable.

The pool cleaning robot may include a motor that may be configured to assist in propelling the pool cleaning robot during the exit process.

The pool cleaning robot may include a winch that may be configured to propel the pool cleaning robot during the exit process.

The pool cleaning robot may include at least one aperture for draining fluid from the pool cleaning robot during the exit process; and a controller that may be configured to affect a timing of at least one phase of the exit process based upon an estimated or an actual amount of the fluid within the pool cleaning robot.

The pool cleaning robot may include at least one aperture for draining fluid from the pool cleaning robot during the exit process; and a controller that may be configured to affect a timing of at least one phase of the exit process based upon an aggregate weight of the pool cleaning robot and the fluid within the pool cleaning robot.

The pool cleaning robot may include a controller that may be configured to prevent a center of the pool cleaning robot from passing an edge of the pool before an amount of fluid that resides in the pool cleaning robot may be below a predefined threshold.

The one or more second interfacing elements may be configured to reduce a friction between an edge of the pool and the pool cleaning robot during the portion of the exit process.

At least one of the one or more second interfacing elements may be coupled to a bottom of the housing.

The pool cleaning robot may include a drive system that may include a main portion and an auxiliary portion; wherein the auxiliary portion may be arranged to move the pool cleaning robot during the portion of the exit process; and wherein the main portion may be arranged to move the pool cleaning robot when the robot cleans the pool.

According to an embodiment of the invention there may be provided a pool cleaning robot for cleaning a pool, the pool cleaning robot may include a housing; a first interfacing element may be configured to interface between the pool cleaning robot and a bottom of a pool while the pool cleaning robot cleans the bottom of the pool; and an movable handle that may be configured to be coupled, at an anchor area, to an external system interface; wherein the movable handle may be configured to elevate the anchor area during a portion of an exit process in which the pool cleaning robot, with an assistance of the external system, exits the pool; wherein the external system may be positioned outside the pool.

The pool cleaning robot may include one or more second interfacing elements that may be configured to reduce a friction between the pool and the pool cleaning robot during at least a portion of the exit process.

The pool cleaning robot may include an interface manipulator that may be configured to move the intermediate element between a first position to the second position thereby changing the distance between the housing and the external system.

According to an embodiment of the invention there may be provided a pool cleaning robot for cleaning a pool, the pool cleaning robot may include a housing; a first interfacing element may be configured to interface between the pool cleaning robot and a bottom of a pool while the pool cleaning robot cleans the bottom of the pool; and a second interfacing element that may be configured to interface between the pool cleaning robot and an exterior surface during a portion of an exit process in which the pool cleaning robot exits the pool; and wherein the second interfacing element may be configured not to contact the bottom of the pool when the pool cleaning robot cleans the bottom of the pool.

According to an embodiment of the invention there may be provided a pool cleaning robot for cleaning a pool, the pool cleaning robot may include a housing; a first interfacing element may be configured to interface between the pool cleaning robot and a bottom of a pool while the pool cleaning robot cleans the bottom of the pool; one or more second interfacing elements that may be configured to contact an edge of the pool during an exit process during which the pool cleaning robot exits the pool; and an interface manipulator that may be configured to change a spatial relationship between the housing and the one or more second interfacing elements thereby preventing a given second interfacing element of one or more second interfacing elements to contact the bottom of the pool while the pool cleaning robot cleans the bottom of the pool.

According to an embodiment of the invention there may be provided a pool cleaning robot for cleaning a pool, the pool cleaning robot may include a housing; a first interfacing element may be configured to interface between the pool cleaning robot and a bottom of a pool while the pool cleaning robot cleans the bottom of the pool; one or more second interfacing elements that differ from the first interfacing element and may be configured to contact an edge of the pool during an exit process during which the pool cleaning robot exits the pool; at least one aperture for draining fluid from the pool cleaning robot during the exit process; and a controller that may be configured to control a timing of at least one portion of the exit process in response to actual or estimated amount of fluid within the pool cleaning robot.

According to an embodiment of the invention there may be provided a system for extraction of a pool cleaning robot from a pool, the system may include a cable that may be arranged to be coupled to a pool cleaning robot during an exit process during which the pool cleaning robot may be extracted from the pool; a cable manipulator for pulling the cable during the exit process; and a controller that may be configured to control the pulling of the cable based on an estimated or an actual amount of the fluid within the pool cleaning robot.

According to an embodiment of the invention there may be provided a method for extracting a pool cleaning robot from a pool, the method may include pulling a cable that may be coupled to the pool cleaning robot during an exit process during which the pool cleaning robot exits the pool; and controlling, by a controller of a system, the cable based on an estimated or an actual amount of the fluid within the pool cleaning robot.

The system may be positioned at a predefined distance from an edge of the pool.

The pulling may be executed by a motor and a reel; and wherein a part of the reel may be positioned below the edge of the pool.

Any combination of any elements, components, parts and/or features that appear in any of the figures and/or any paragraph of the specification and/or any claim may be provided.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which

DESCRIPTION OF THE PREFERRED EMBODIMENTS

Figure 1:
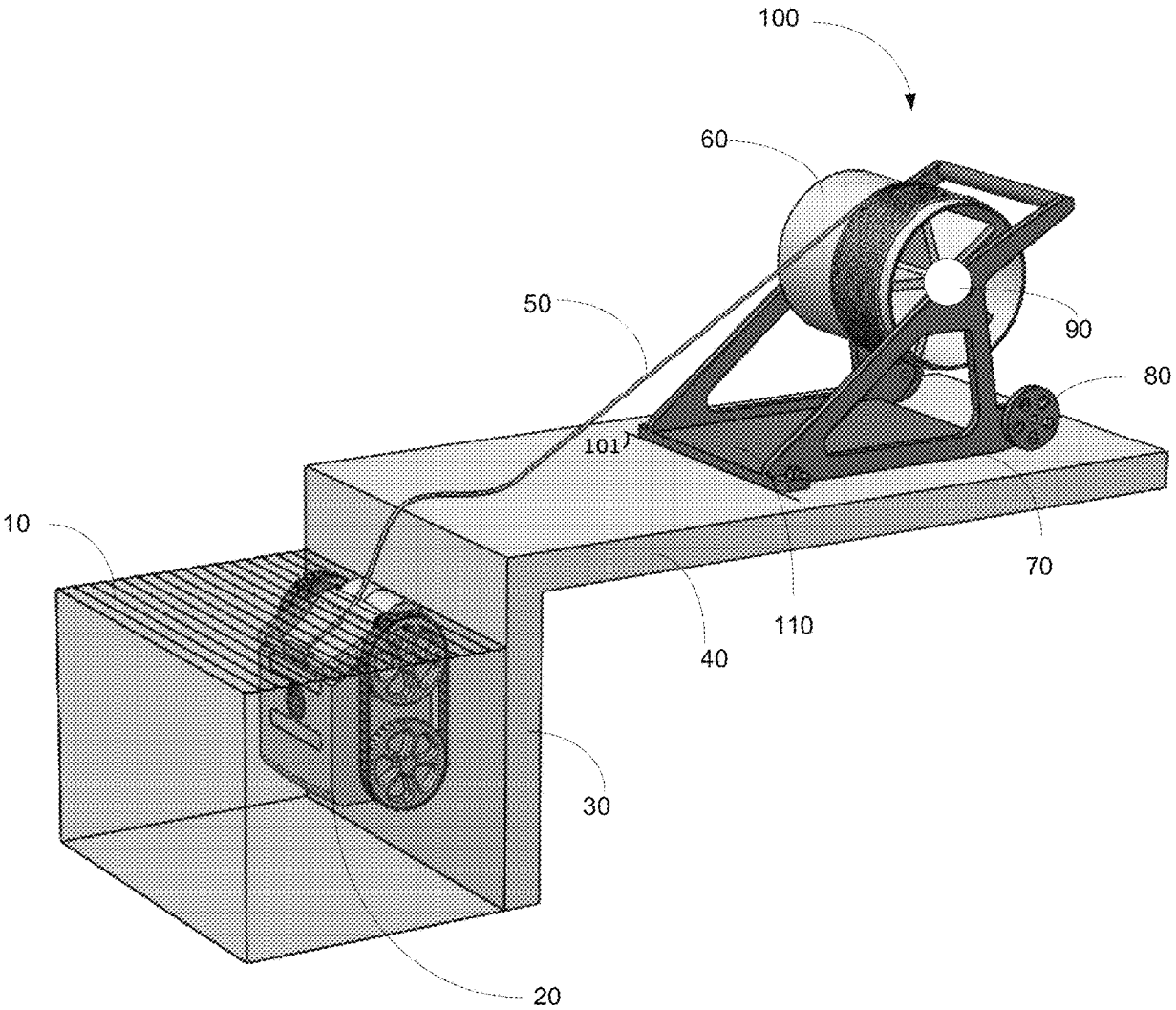
FIG. 1 illustrates a pool cleaning robot that climbs on a sidewall of the pool while propagating towards a docking station and a cable that connects the pool cleaning robot to a docking station is loose according to an embodiment of the invention.

In the following description specific details are set forth in order to provide a thorough understanding of the invention.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Any reference in the specification to a system should be applied mutatis mutandis to a method that can be executed by the system.

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference in the specification to a method should be applied mutatis mutandis to a system capable of executing the method.

There may be provided a pool cleaning robot for cleaning a pool, the pool cleaning system may include a housing; and a drive system, wheels and/or tracks, cleaning brushes, a pump system, a filtering system, a tethered electrical cable and an electronic control system that may be arranged to move the pool cleaning robot in relation to an environment of the pool cleaning robot.

The electronic control may receive inputs from sensors and/or accelerometer that govern the performance and environment of the pool cleaning robot.

According to an embodiment of the invention there may be further provided a pool cleaning system that comprises a pool cleaning robot in conjunction of a separate cable-reel/winch that is external to the pool and that may be able to autonomously exit the pool cleaning robot from the pool.

The pool cleaning robot may be coupled to a docking station (also referred to as system or external system) that is located outside the pool by a cable such as but not limited to an electrical cable that is tethered to the pool cleaning robot on its first end and to a cable reel/winch on its second end. Alternatively—the electrical cable may be provided in additional to a cable that is mechanically coupled to the system.

The tethered cable or the tethered electrical cable may include reinforcing fiber strands that may comprise aramid strands. The cable may be further reinforced internally with additional aramid strands or other carbon type strands in order to withstand the extended stresses on the cable that may cause tearing.

The pool cleaning system may include the said pool cable-reel/winch that is able to interact both mechanically and electronically with the pool cleaning robot.

The process of exiting from the pool may direct the pool cleaning robot onto a docking station that may comprise the a cable-reel/winch and a power supply and a cable reel/winch drive motor and a control box able to govern the cable-reel/winch and communicate with the pool cleaning robot control box by wire or wireless means.

A manual override handle or other man machine interface (not shown) may be used to manually reel-in and pull out the pool cleaning robot from the pool.

In another embodiment, the cable reel/winch is an independent system that is not located on a docking station and may comprise a reel, a drive motor, electrical supply and power supply with said independent system is bolted or attached to the ground or another immovable anchoring element so that, for safety reasons, it may not detach and reach the pool water.

An immovable anchoring element may for example be the wall of a house or a concrete, metal or wooden pole of any solid built construction in the vicinity of the swimming pool.

A number of pool cleaning robot services may be provided whilst the pool cleaning robot is positioned on a docking station. Amongst these services are automatic filter replacement and filter clean up as discussed and in U.S. provisional patent application 61/745,556 filing date 22 Dec. 2012 and PCT patent application PCT/IL2013/051055 filing date 22 Dec. 2013 and U.S. provisional patent 61/992,247 filing date May 13, 2014; Titled: AUTONOMOUS POOL CLEANING ROBOT WITH AN EXTERNAL DOCKING STATION which are incorporated herein by reference in their entirety.

In an alternative option to a docking station/caddy, the said pool cleaning robot will autonomously exit the pool and park in the vicinity of the pool edge and may await end user intervention or another pool cleaning cycle.

In any of above embodiments of exiting the pool, the reverse operation of returning the pool cleaning robot to the pool may be also performed. Namely, the pool cleaning robot will travel from vicinity of pool edge or from the docking station/caddy whilst cable reel/winch releases sufficient slack to tethered cable to reach pool edge. As soon as the cleaner attempts to drop into the pool water the reel/will hold back any further slack to allow the handle to unfold and extend to an upward position thereby allowing smooth and slow descent into the water.

The handle therefore performs a dual purpose by being a carrying handle for the end user but that may also serve as an intermediate element that is used to attach the pool cleaning robot to a docking station by means of the electrical power cord.

The pool cleaning robot depicted in FIGS. 1-18 usually travel on the pool floor or climb the pool walls in order to sweep, brush and suck in dirt and debris that are accumulated on the said surfaces and wall.

In FIGS. 1-4 the pool cleaning robot is denoted 20, the intermediate element is a handle that is denoted 12, an axis of rotation of the handle is denoted 25, a second interfacing element (such as wheel) is denoted 22. The cable that is connected between the pool cleaning robot and the docking station (also referred to system or external system) 100 is denoted 50, the reel of the docking station is denoted 60, a motor/winch of the docking station is denoted 90.

Figure 7:
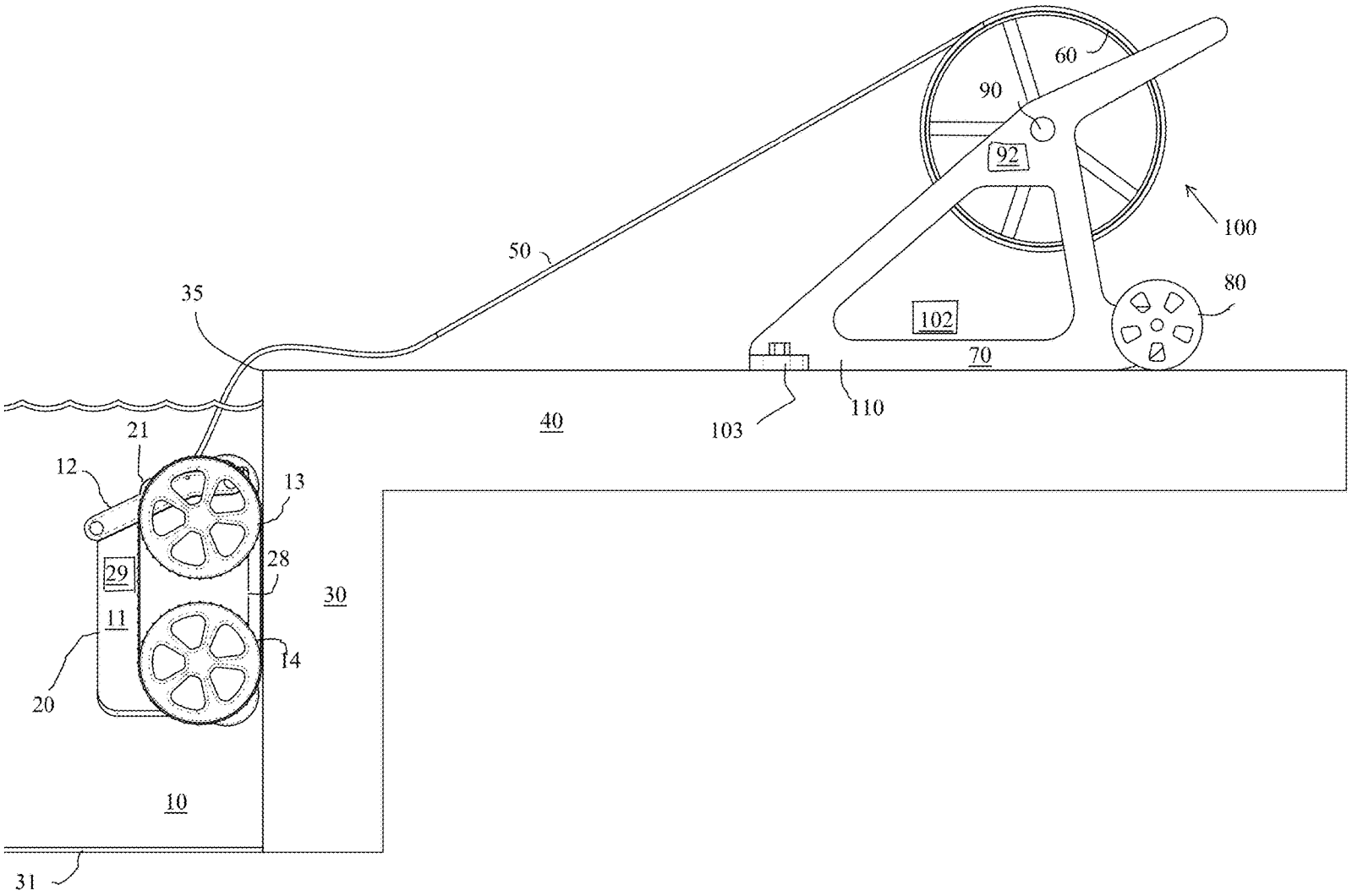
FIG. 7 illustrates a pool cleaning robot that climbs on a sidewall of the pool while propagating towards a docking station and the cable that connects the pool cleaning robot to a docking station is loose according to an embodiment of the invention.
Figure 8:
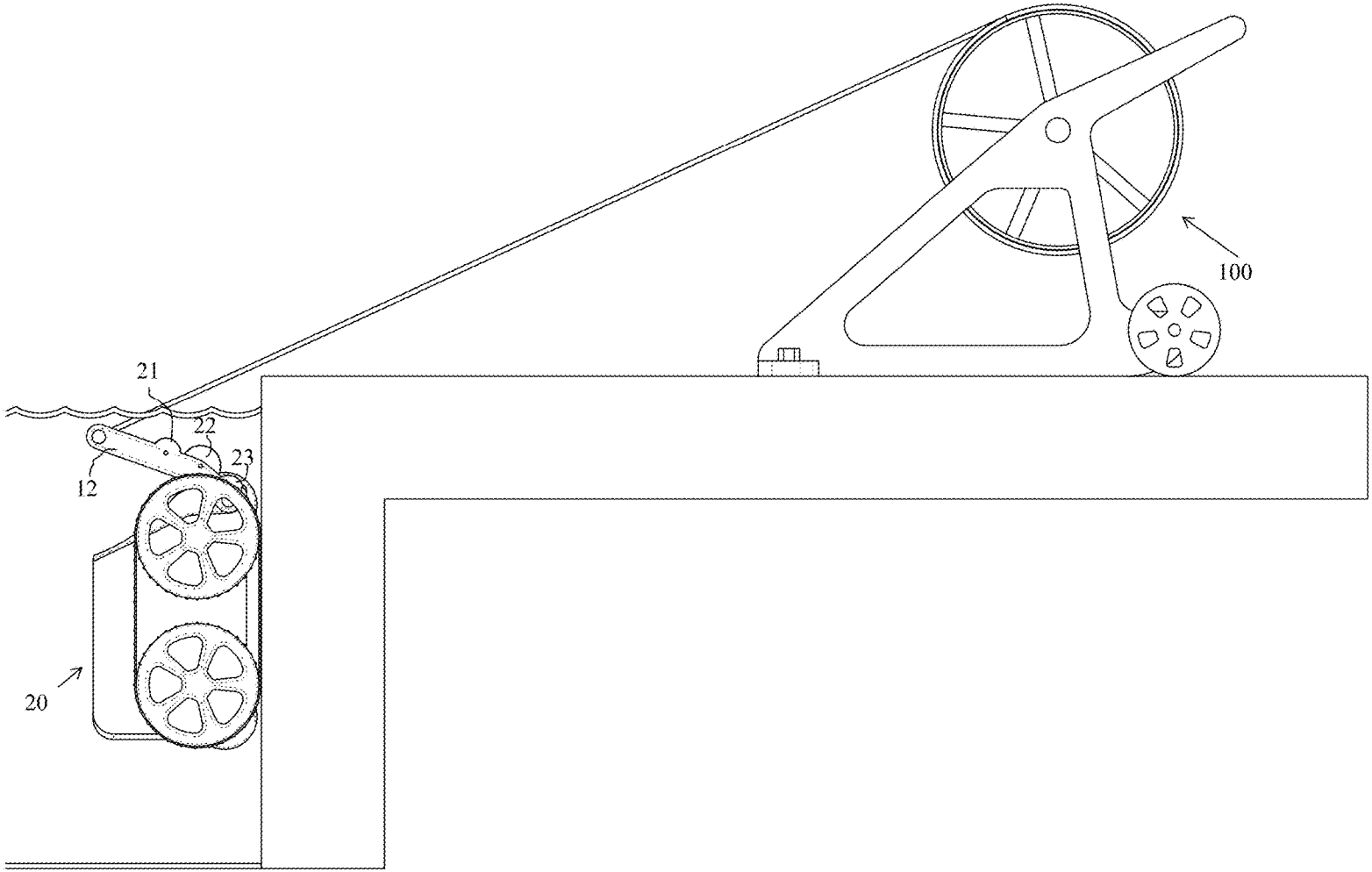
FIG. 8 illustrates a pool cleaning robot that is still underwater but is proximate to an edge of the pool and the cable that connects the handle of the pool cleaning robot to a docking station and the handle is partially opened—in an intermediate position according to an embodiment of the invention.
Figure 9:
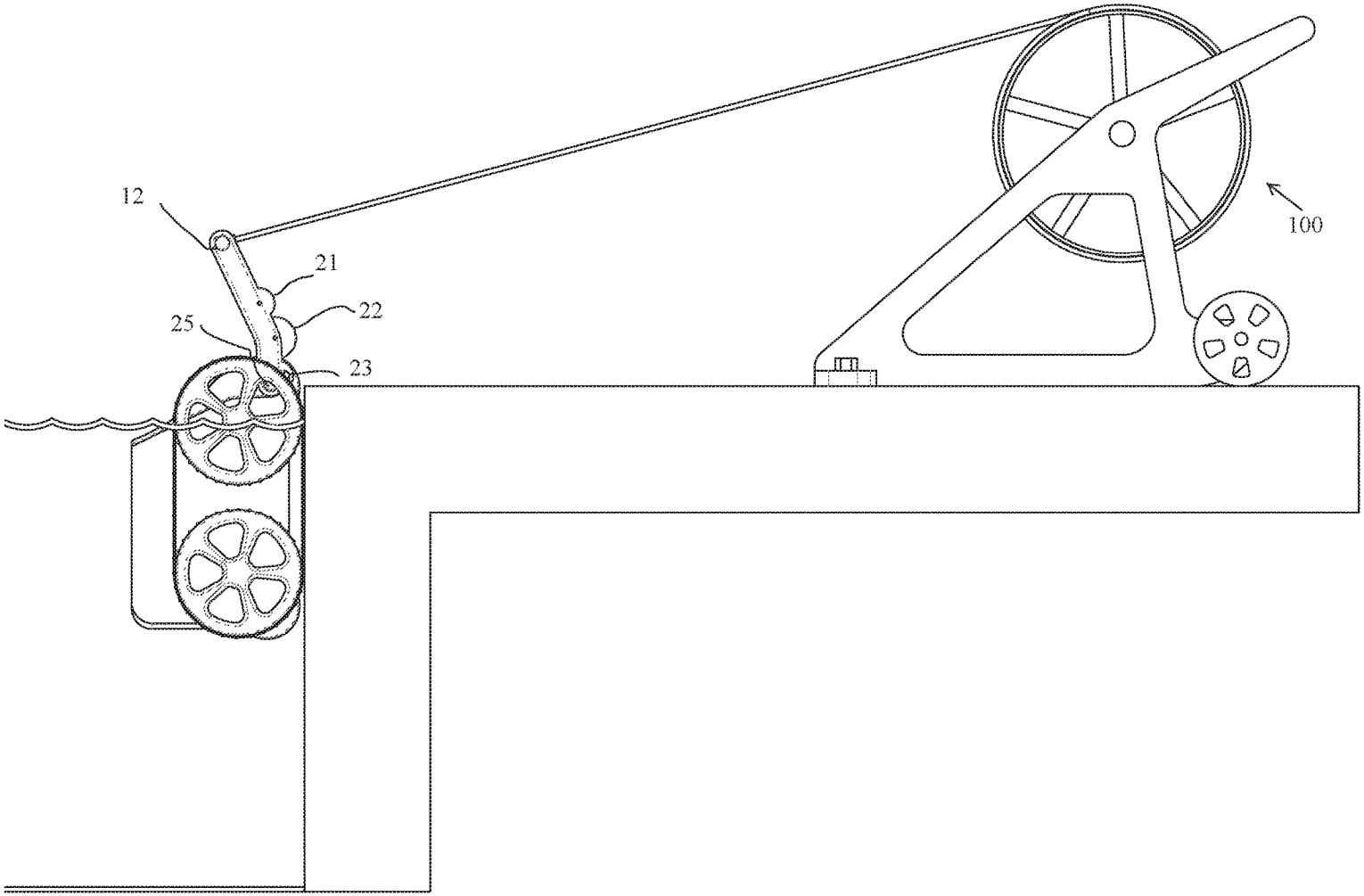
FIG. 9 illustrates a pool cleaning robot that is partially above the water of the pool, still in a vertical position and proximate to an edge of the pool, wherein the cable that connects the handle of the pool cleaning robot to a docking station is tense and the handle is in an open position according to an embodiment of the invention.

In FIG. 7 the pool cleaning robot is illustrated as including a controller 29, sensor 11 and an aperture 28 for draining fluid. The pool cleaning robot may have more than a single sensor, more than a single aperture and the positions of the aperture, controller and sensor may differ from those illustrated in FIG. 7. For example, the sensor 11 may be floating in the fluid within the pool cleaning robot and its location is indicative of the amount of fluid in the pool cleaning robot. The sensor 11 may track after a floating element that floats in the fluid within the pool cleaning robot and the location of the floating element is indicative of the amount of fluid in the pool cleaning robot. The sensor may be an optical sensor, a pressure sensor that tracks the fluid within the pool cleaning sensor. There may be provided an orientation sensor and a timer for monitoring the exit process. The duration of the pool cleaning robot at each orientation during the exit process may provide an estimate of the amount of fluid within the pool cleaning robot.

It is noted that the pool cleaning robot may include the controller and not the sensor or the sensor and not the controller.

It should be noted that the depiction of the distances of the docking stations 100 from the pool's edge in FIGS. 1-18 and 24 are purely illustrative. Distances and other relevant parameters may vary according to national electrical regulations prevailing in each country or county where said station may be installed.

In FIGS. 1-12 the docking station is positioned above the external surface 40 and includes a frame 70, wheels 80, lower surface 110 on which the pool cleaning robot 20 can climb and be positioned above. The docking station 10 also includes a controller (denoted 102 in FIG. 7) for controlling the exit process.

In FIGS. 13-18 the docking system 100 is located within a space 200 formed in the external surface 40 that may be a pool deck, the space 200 may include a sealed cover 202 with a hole and be equipped with cable guiding idler rollers (not shown) in which cable can pass through. The bottom of the docking station is located below the edge 35 of the pool and may include a subterranean electrical junction box, a water drain and the like. Docking system 100 may include a controller and/or a sensor—but they are not shown for brevity of explanation.

The pool includes water 10 and a sidewall 30 that interfaces with an external surface 40. The motor 90 may be positioned inside the reel (As shown in FIG. 1), outside the rail and be fed by electricity from a mains power outlet, may belong to the robot, the docking station or belong to a third element. Both pool cleaning robot and the docking station may include motors. The docking station may be static, may move along the external surface and the like.

The pool (or external surface) may include or may be connected to stoppers that may prevent the docking station to enter the pool or move beyond the stoppers. For example line 101 of FIG. 1 may represent a stopper and element 103 of FIG. 7 may represent a fastening element that fastens the docking station to the external surface in any conceivable method.

It is noted that the exit process of the pool cleaning robot from the pool can be done by using the drive power of the pool cleaning robot and/or the reel of the docking station. For example—any phase of the exit process of FIGS. 2-7 may be executed by using the reel and/or the pool cleaning robot.

Figure 2:
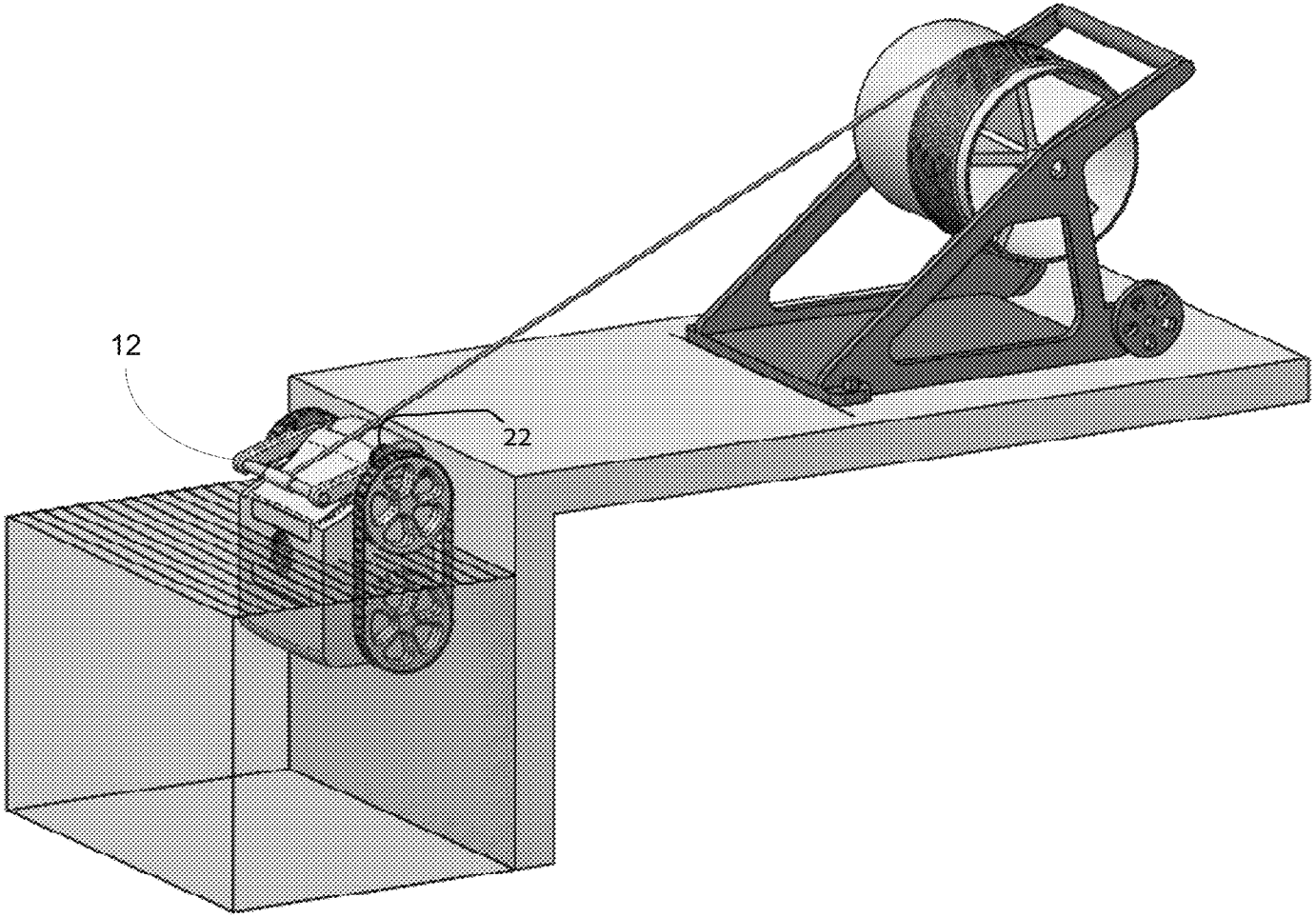
FIG. 2 illustrates a pool cleaning robot that is proximate to an edge of the pool and a cable that connects a handle of the pool cleaning robot to a docking station is tense and the handle is in a closed position according to an embodiment of the invention.
Figure 3:
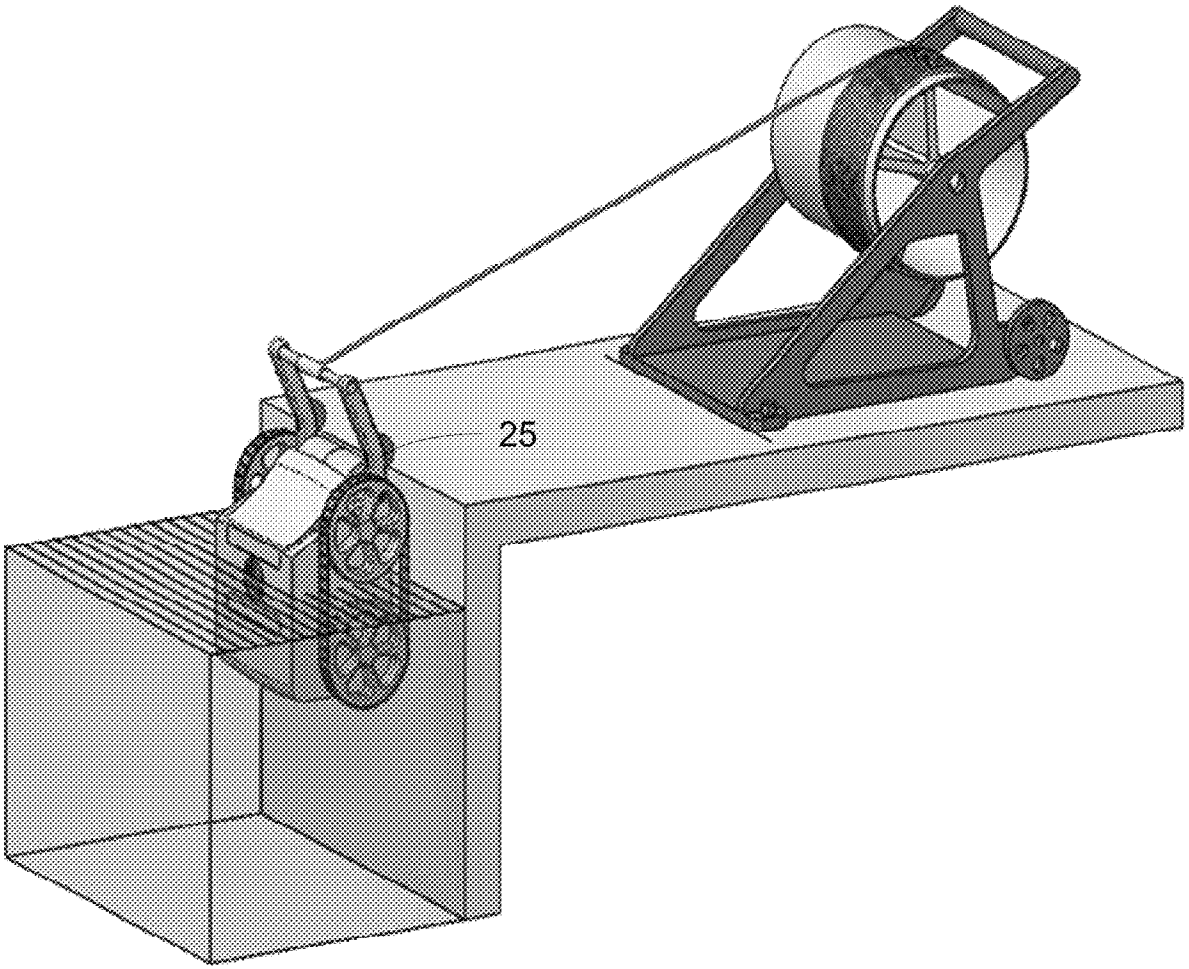
FIG. 3 illustrates a pool cleaning robot that is proximate to an edge of the pool and the cable that connects the handle of the pool cleaning robot to a docking station is tense and the handle is in an open position according to an embodiment of the invention.
Figure 4:
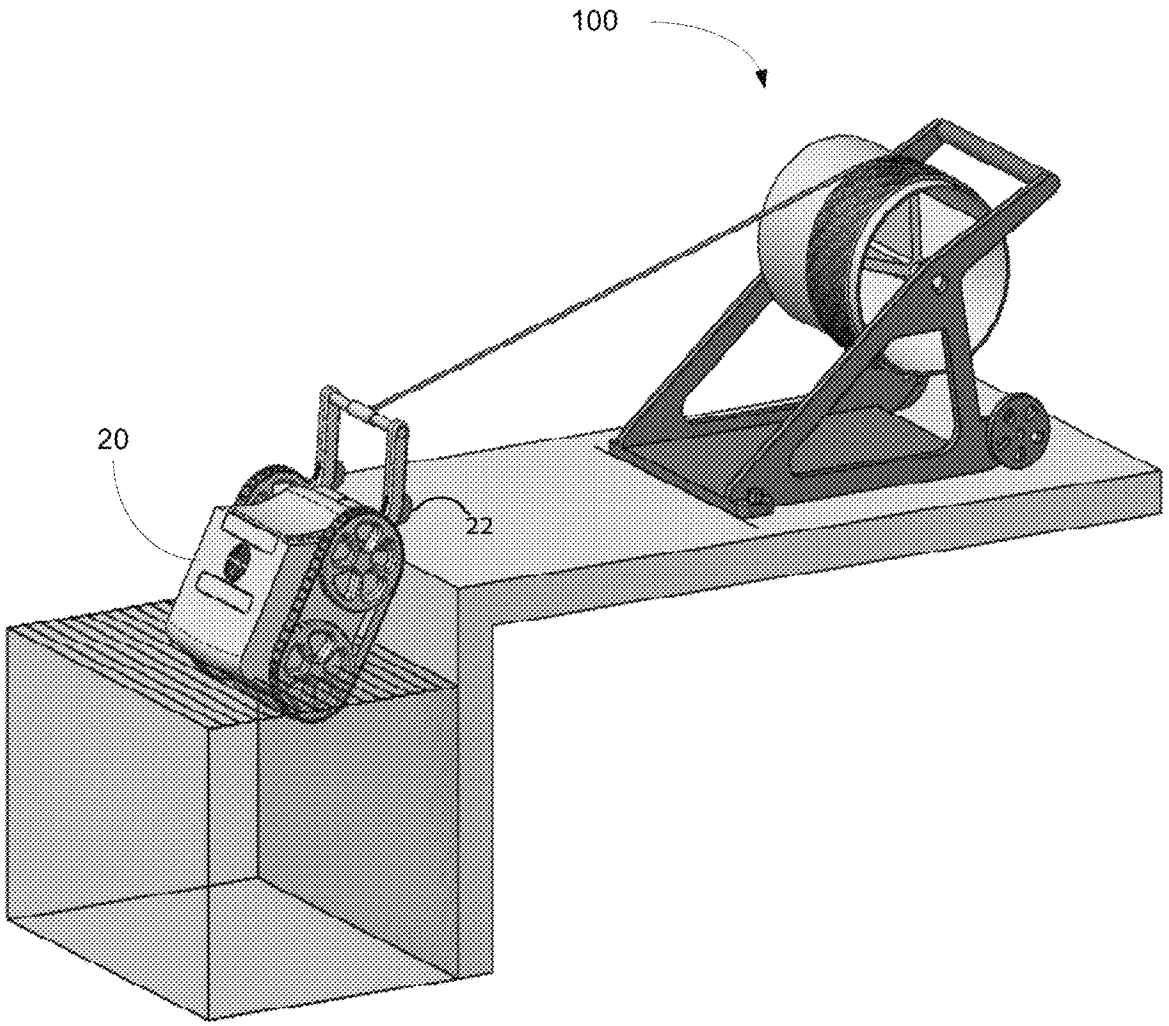
FIG. 4 illustrates a pool cleaning robot is partly outside the water of the pool in an intermediate position in which water can be drained from the pool cleaning robot according to an embodiment of the invention.
Figure 5:
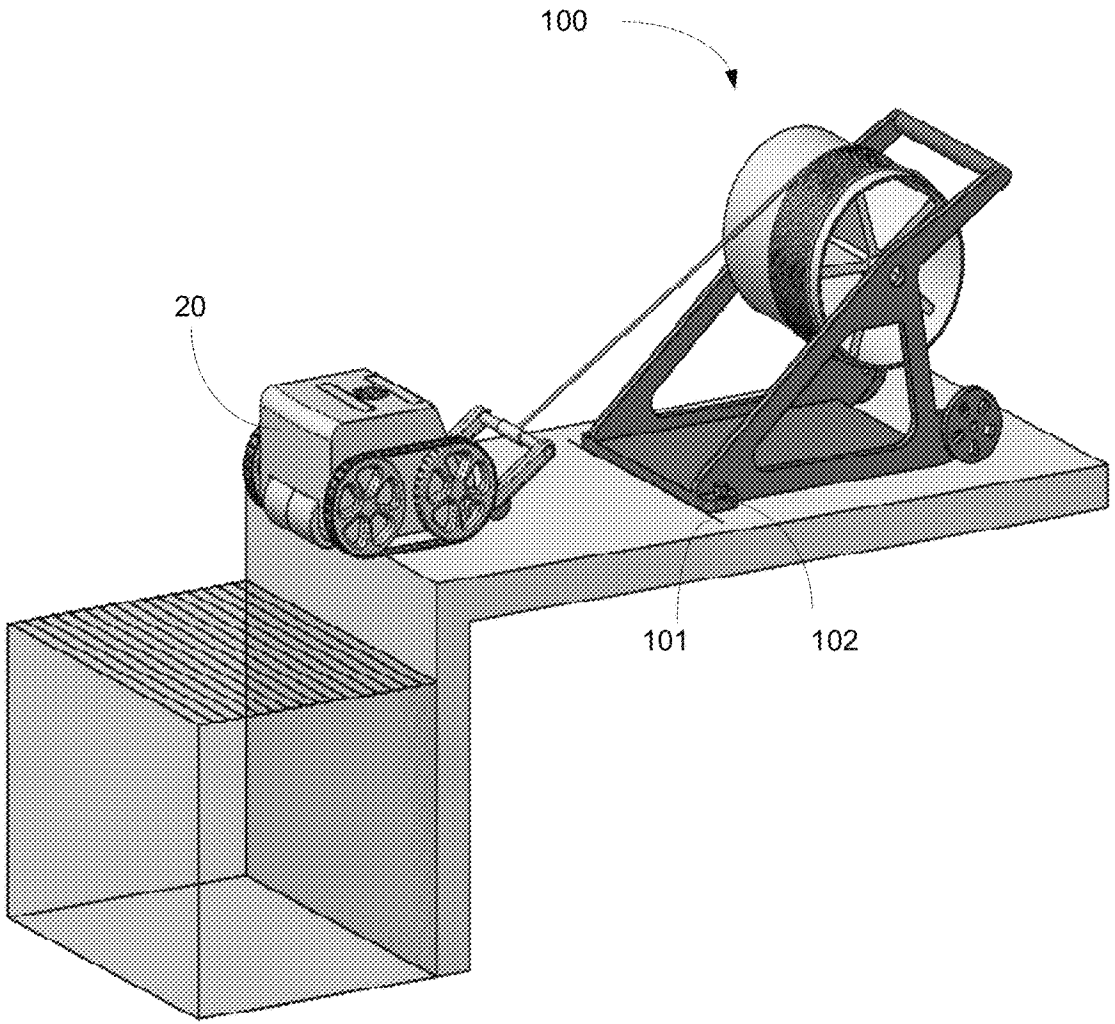
FIG. 5 illustrates a pool cleaning robot is completely outside the water of the pool and propagates towards the docking station according to an embodiment of the invention.
Figure 6:
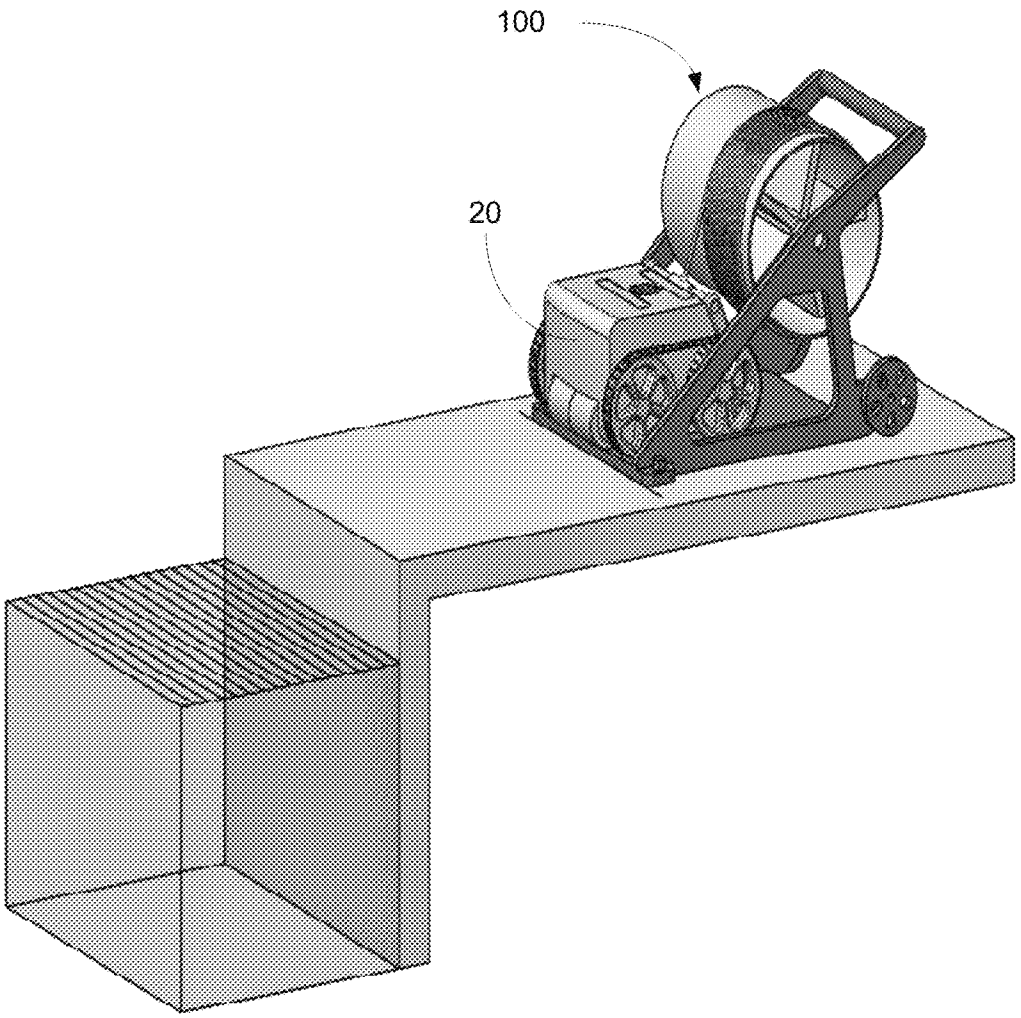
FIG. 6 illustrates a pool cleaning robot is docked at the docking station according to an embodiment of the invention.

It is noted, referring to FIGS. 2-3 that the movement of the handle 12 from a closed position to an open position can be triggered by the tension of the cable but may be triggered by sensors such as height sensors, out of water sensor and the like. The sensor may be sensor 11 of the pool cleaning robot and/or sensor 92 of the docking station 100.

Figure 10:
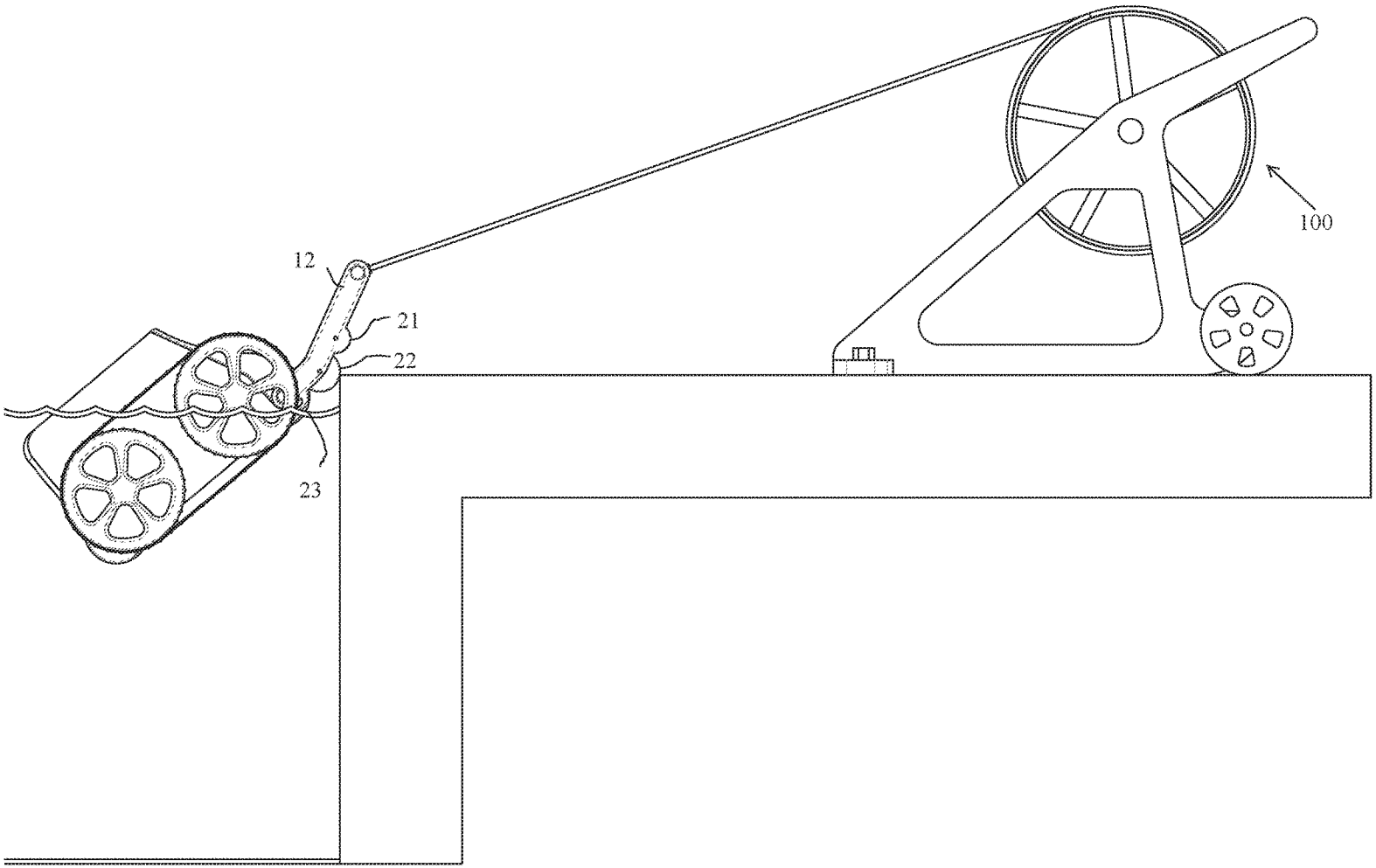
FIG. 10 illustrates a pool cleaning robot is partly outside the water of the pool in an intermediate positon in which water can be drained from the pool cleaning robot, wherein a second interfacing element contacts the edge of the pool according to an embodiment of the invention.
Figure 11:
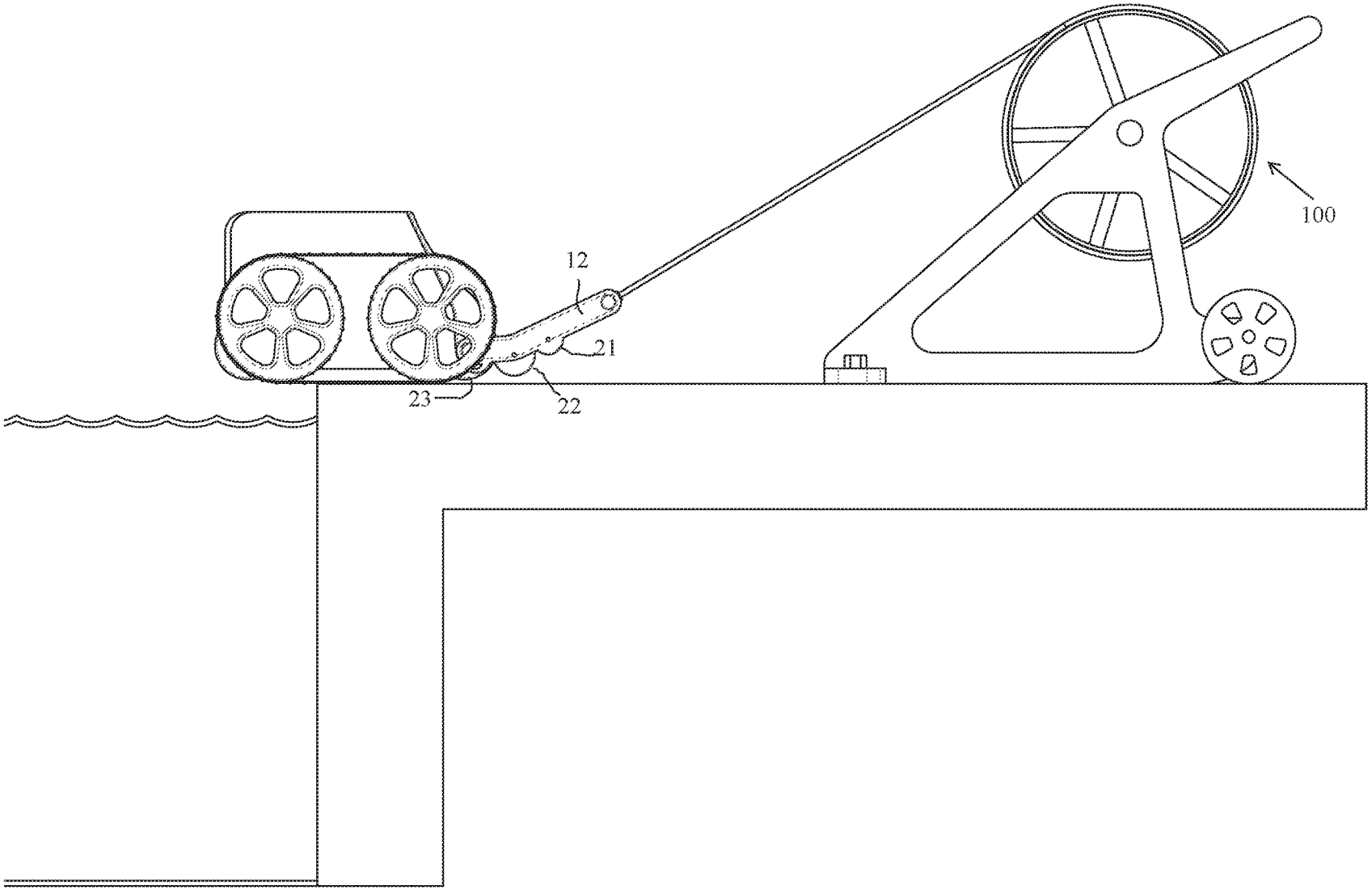
FIG. 11 illustrates a pool cleaning robot is completely outside the water of the pool but is closer to the edge of the pool than to the docking station according to an embodiment of the invention.
Figure 12:
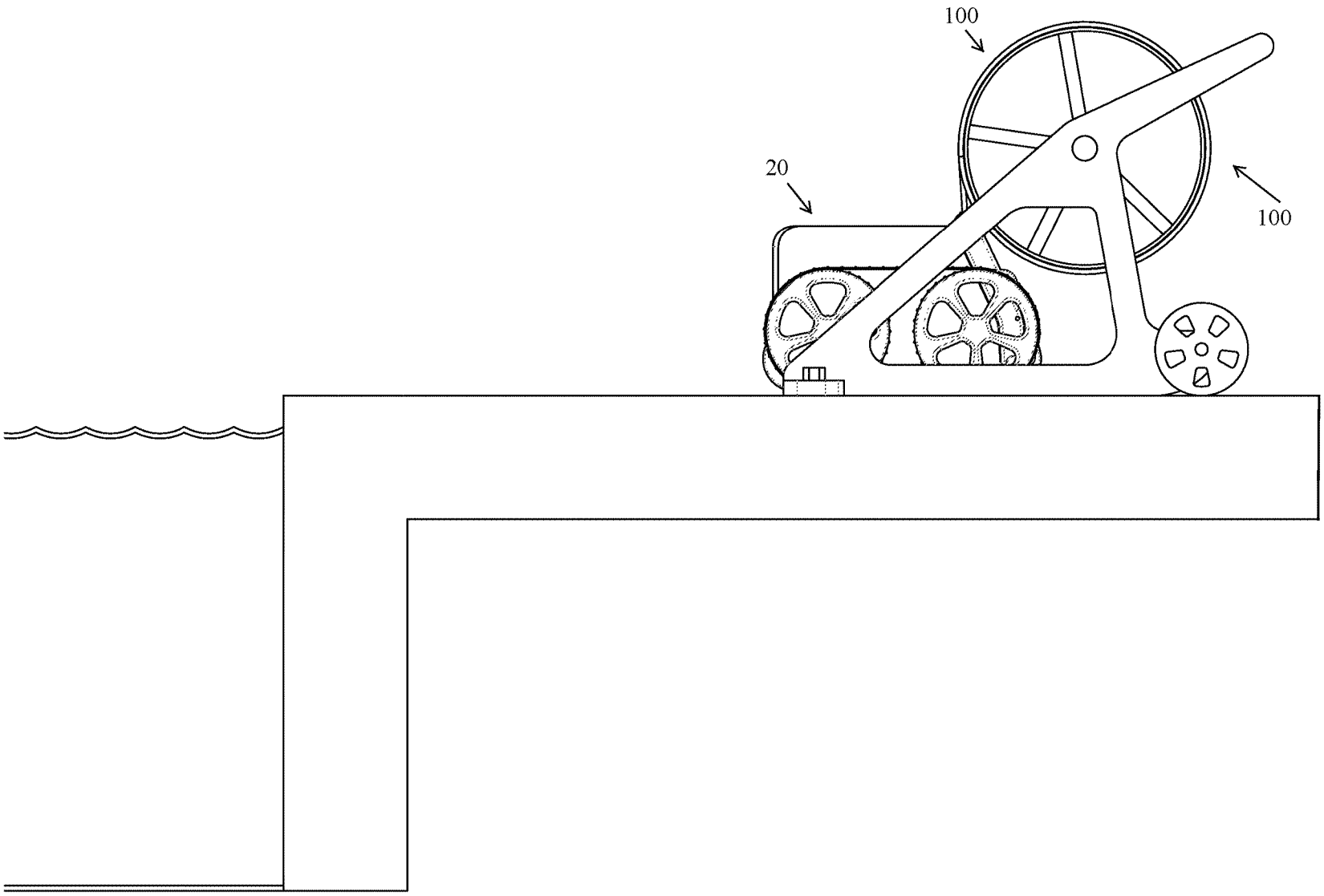
FIG. 12 illustrates a pool cleaning robot is docked at the docking station according to an embodiment of the invention.
Figure 13:
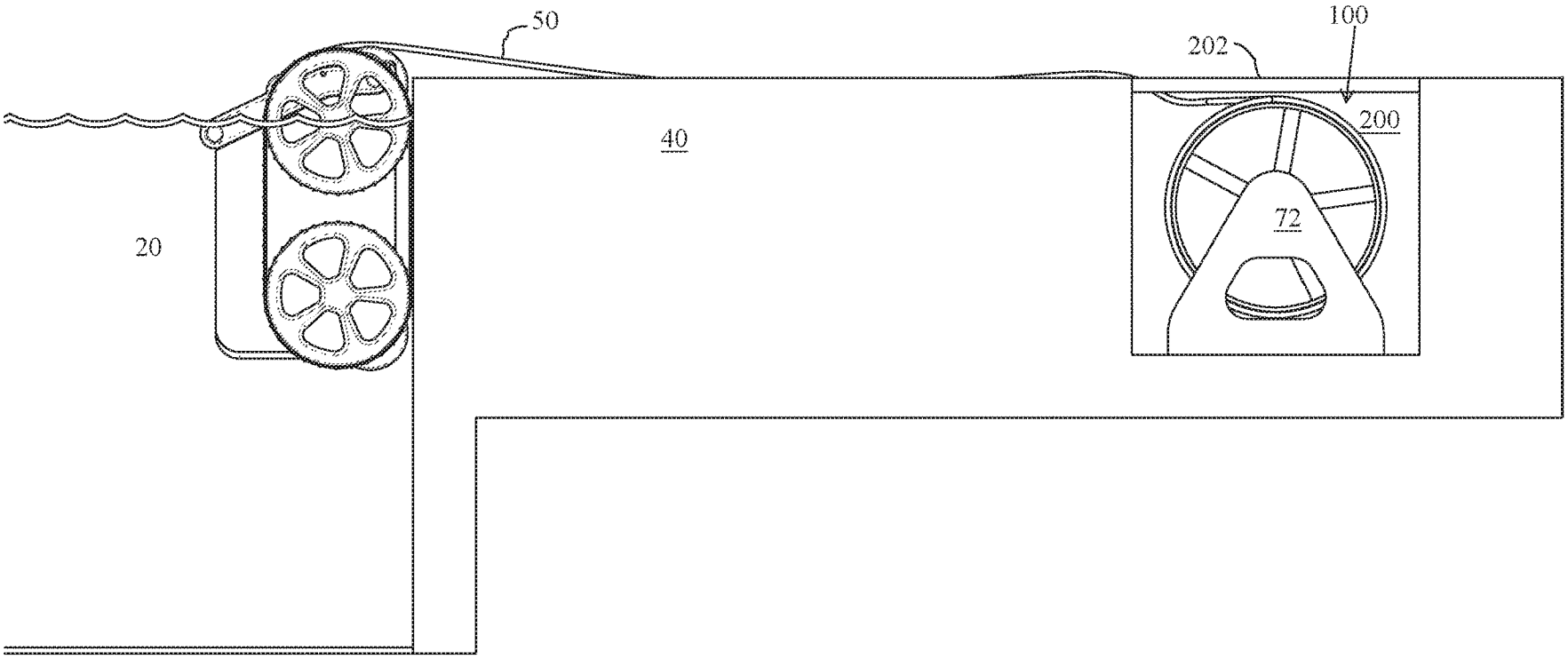
FIG. 13 illustrates a pool cleaning robot that climbs on a sidewall of the pool while propagating towards a docking station and the cable that connects the pool cleaning robot to a docking station is loose according to an embodiment of the invention.
Figure 14:
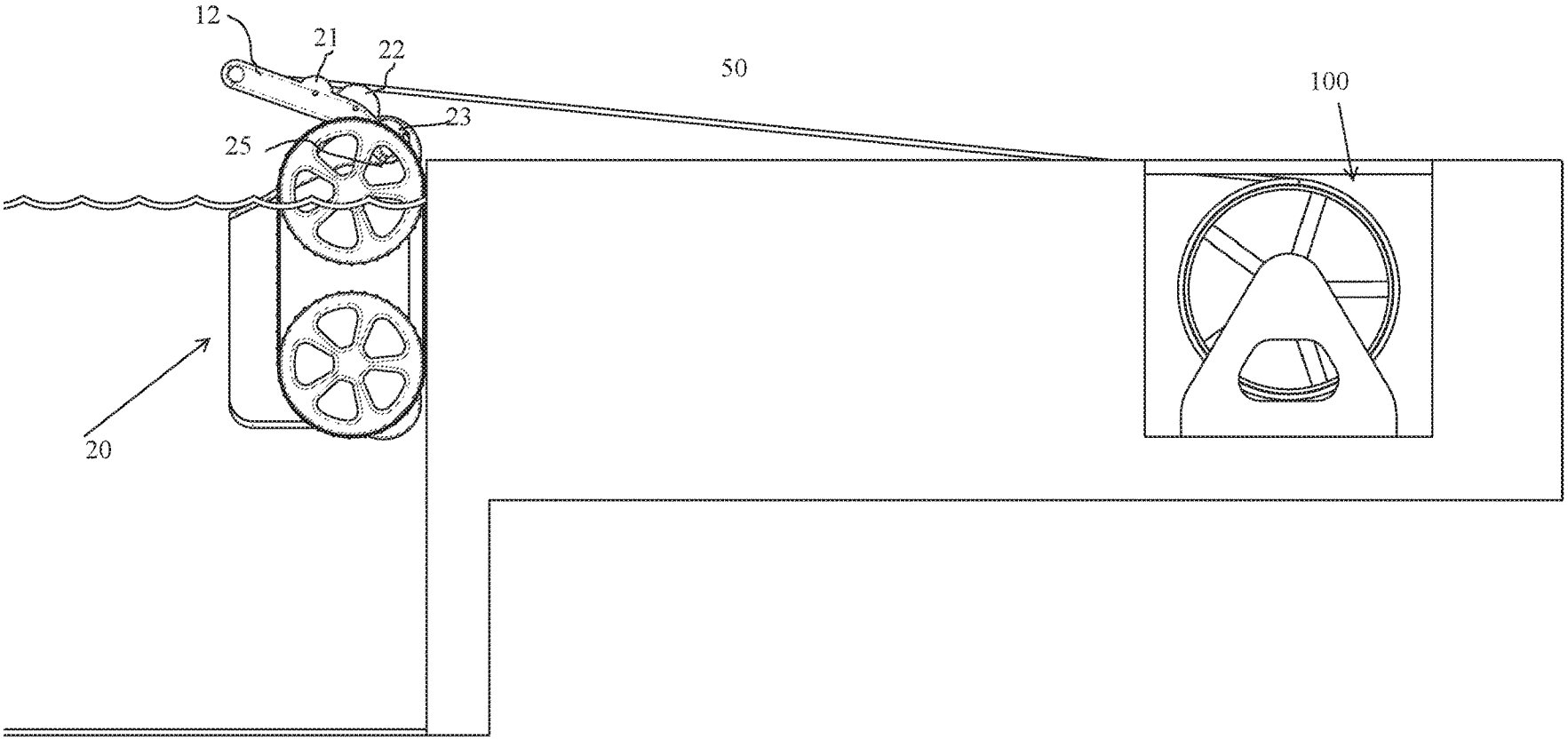
FIG. 14 illustrates a pool cleaning robot that is slightly above the water and is proximate to an edge of the pool and the cable that connects the handle of the pool cleaning robot to a docking station and the handle is partially opened—in an intermediate position according to an embodiment of the invention.
Figure 15:
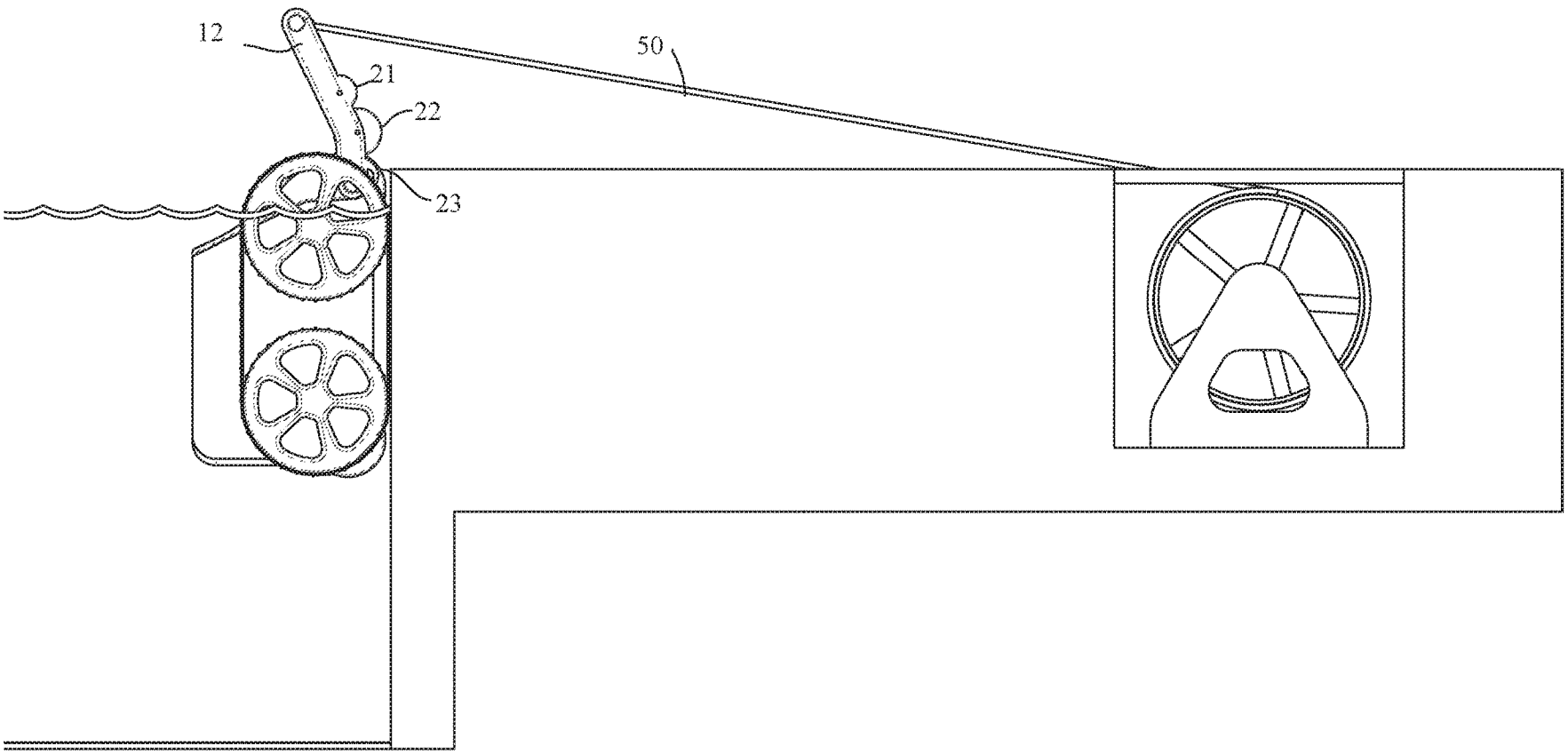
FIG. 15 illustrates a pool cleaning robot that is partially above the water of the pool, still in a vertical position and proximate to an edge of the pool, wherein the cable that connects the handle of the pool cleaning robot to a docking station is tense and the handle is in an open position according to an embodiment of the invention.
Figure 16:
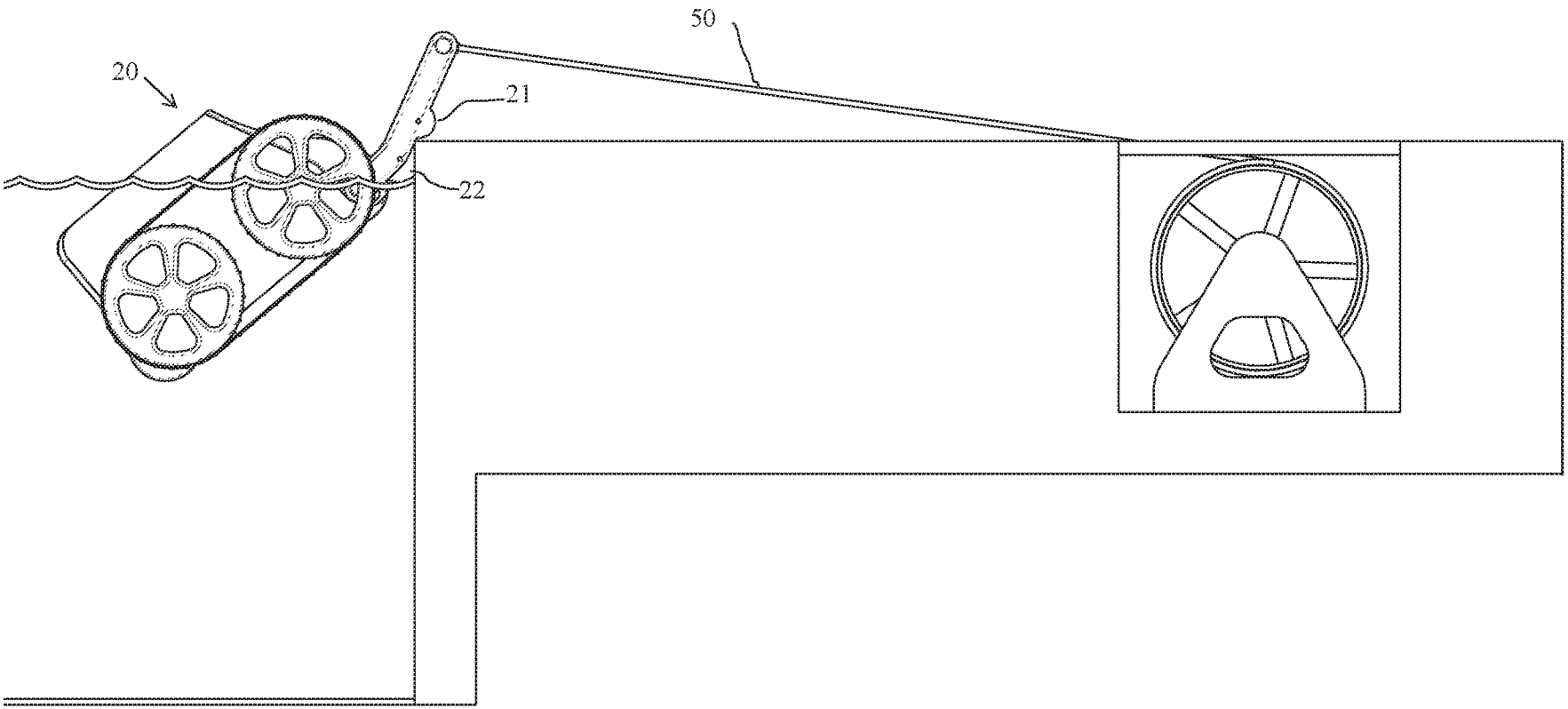
FIG. 16 illustrates a pool cleaning robot is partly outside the water of the pool in an intermediate positon in which water can be drained from the pool cleaning robot, wherein a second interfacing element contacts the edge of the pool according to an embodiment of the invention.
Figure 17:
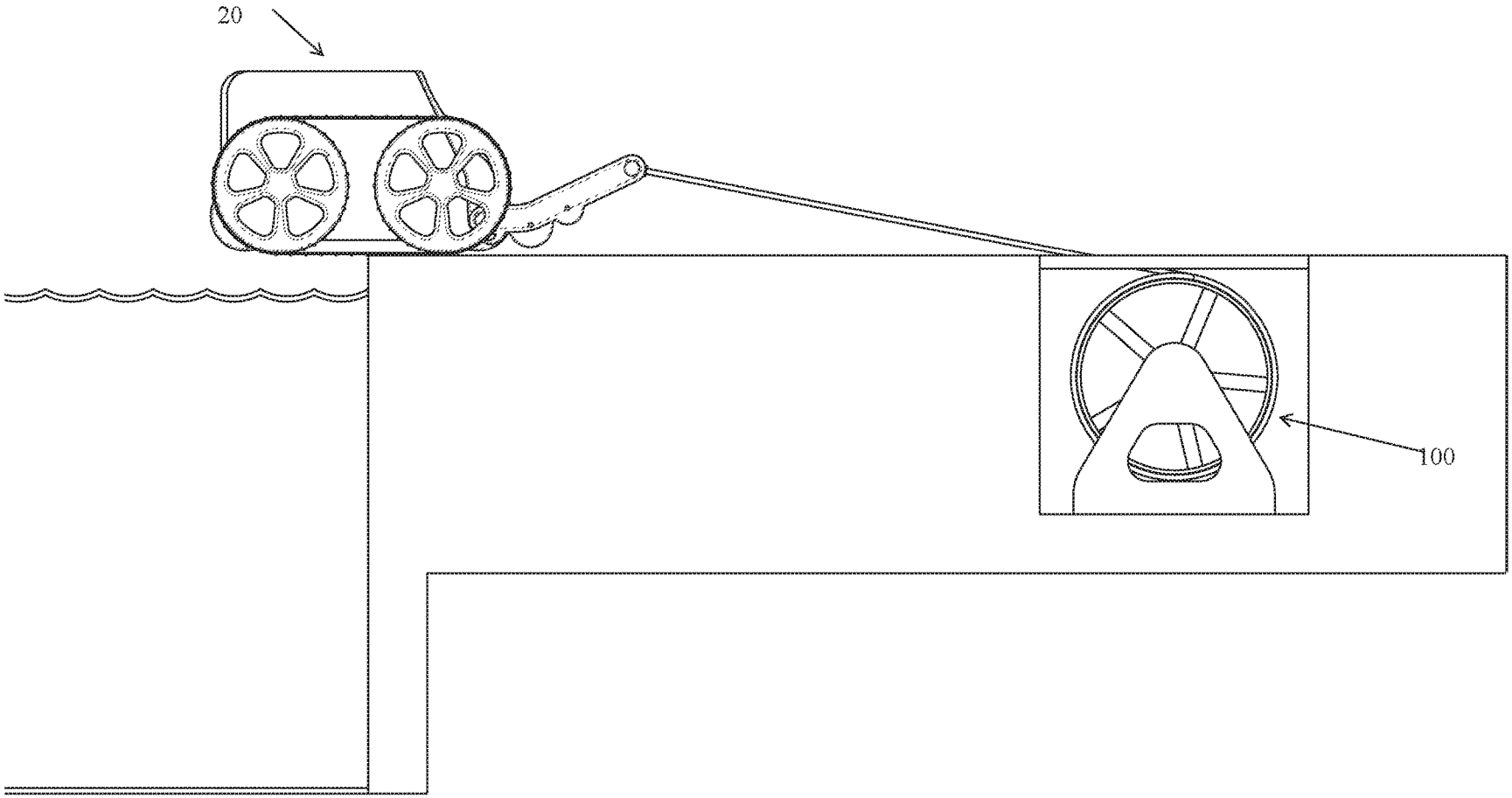
FIG. 17 illustrates a pool cleaning robot is completely outside the water of the pool but is closer to the edge of the pool than to the docking station according to an embodiment of the invention.
Figure 18:
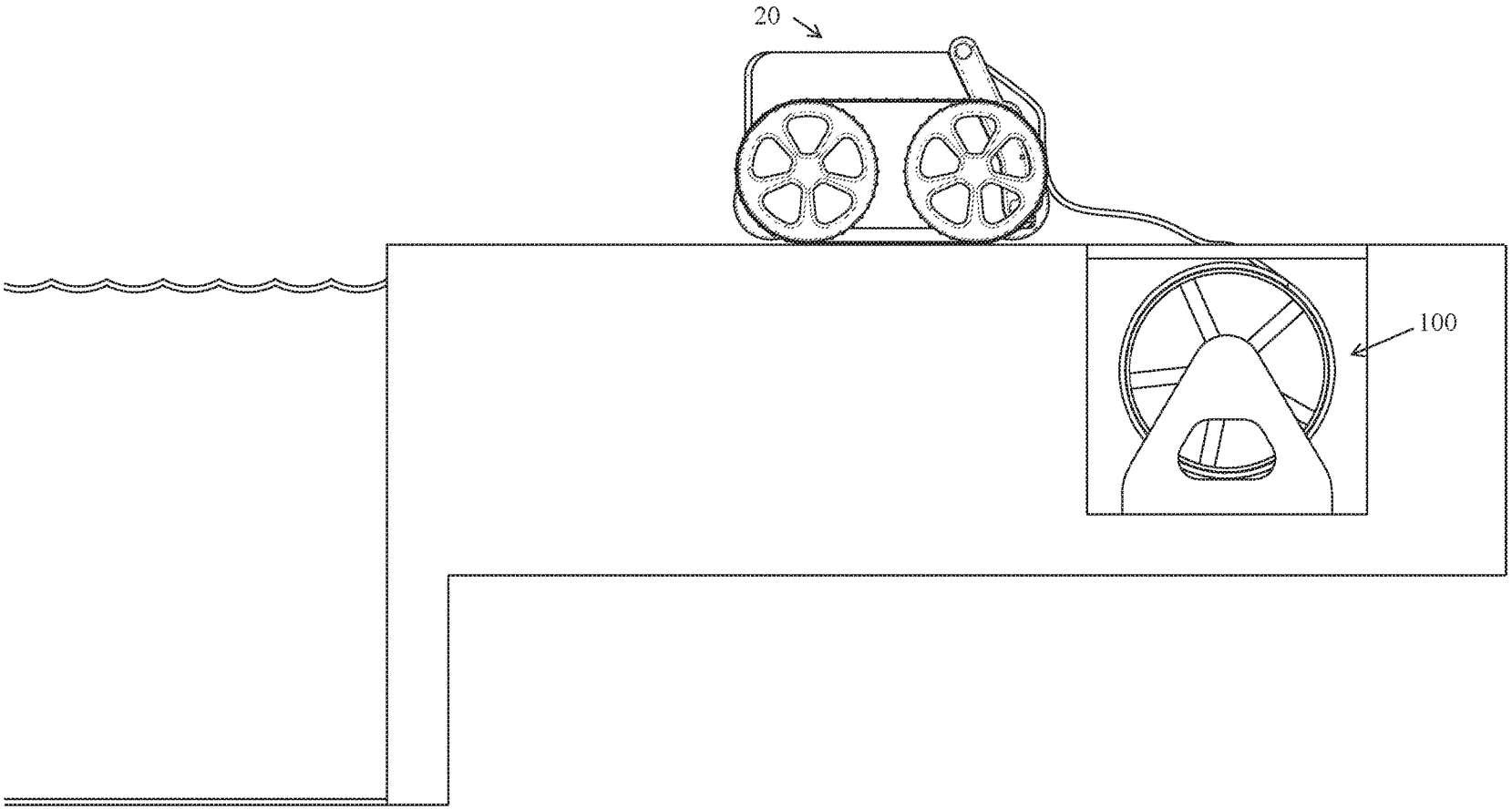
FIG. 18 illustrates a pool cleaning robot is docked at the docking station according to an embodiment of the invention.
Figure 19:
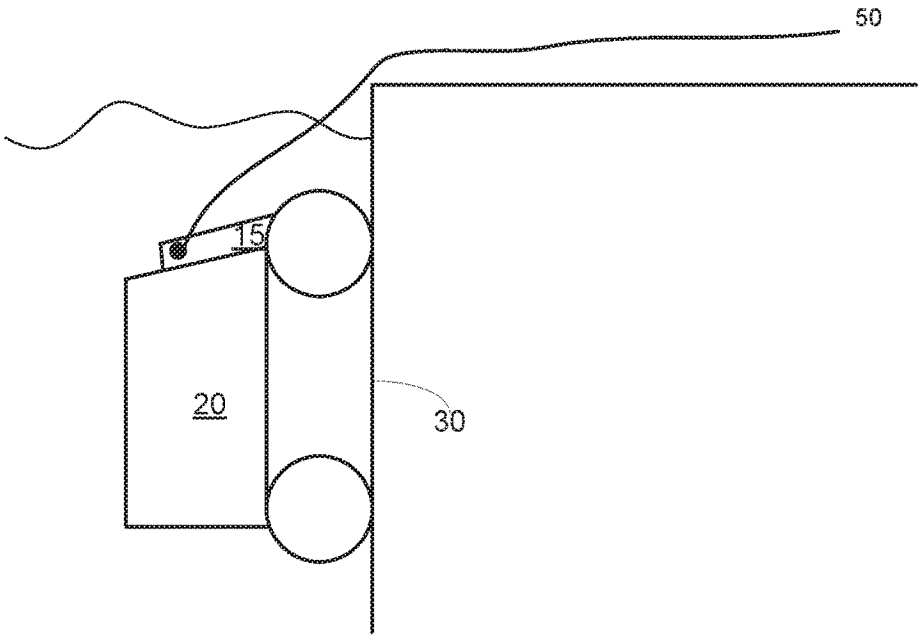
FIG. 19 illustrates a pool cleaning robot according to an embodiment of the invention.
Figure 20:
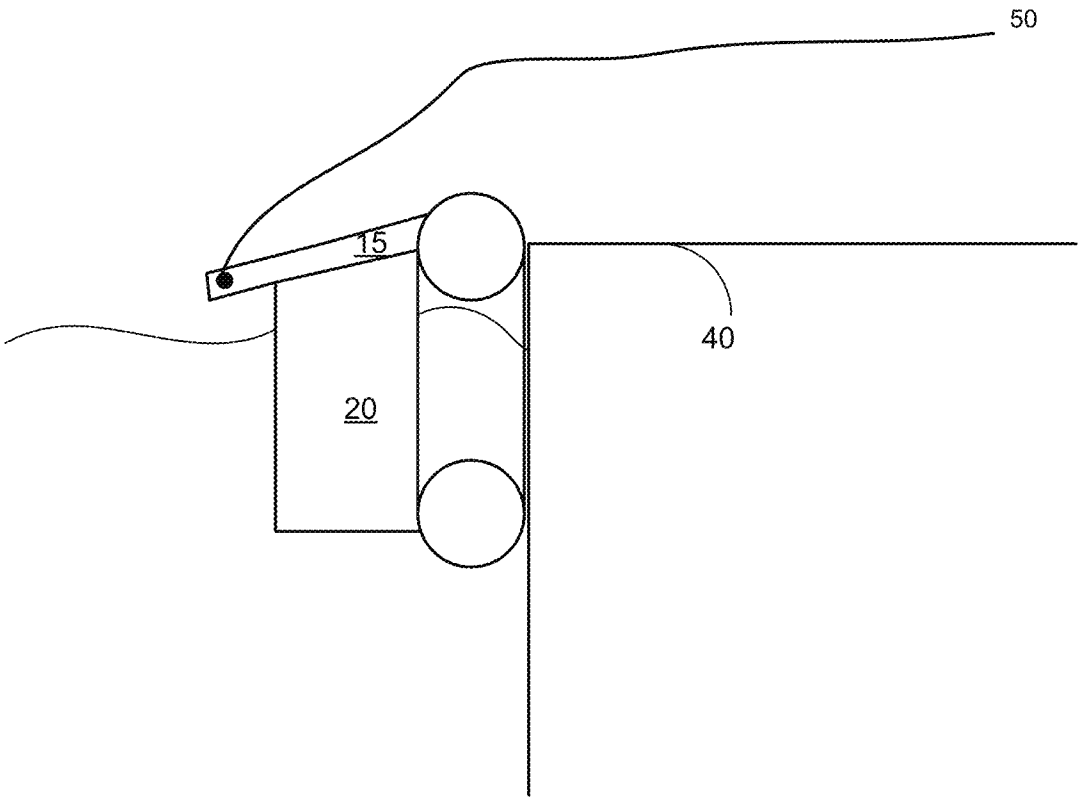
FIG. 20 illustrates a pool cleaning robot according to an embodiment of the invention.
Figure 21:
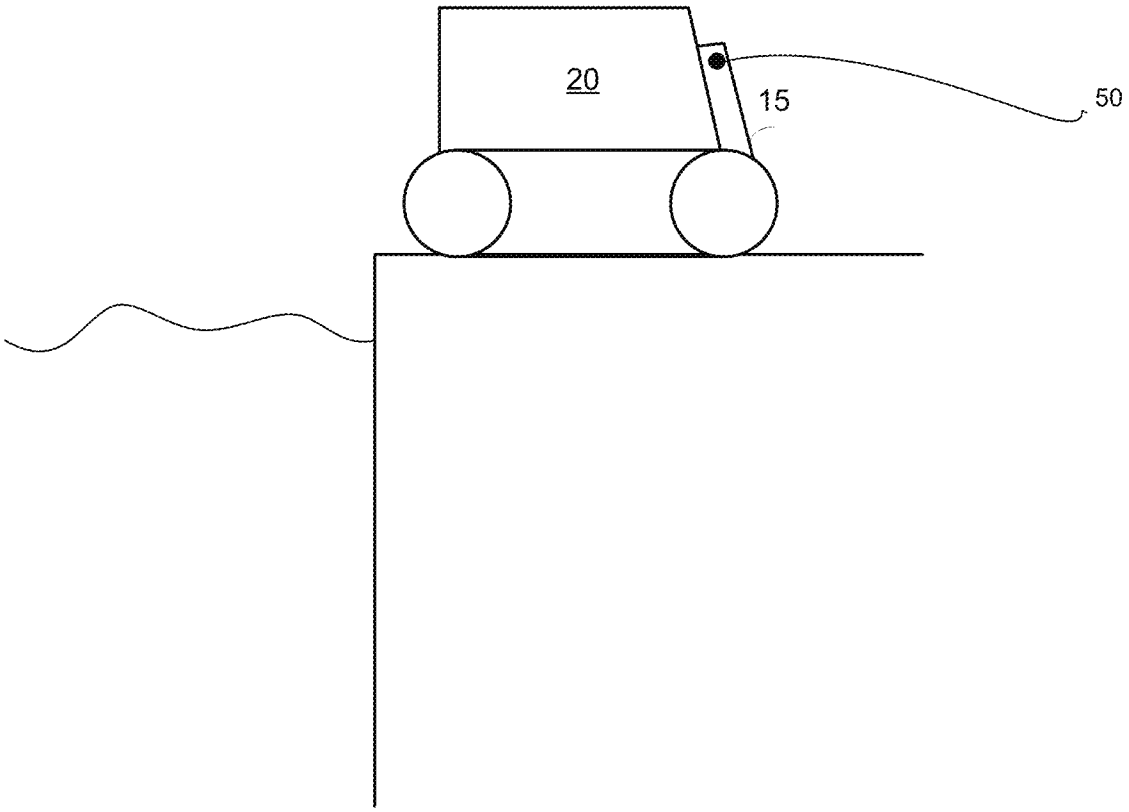
FIG. 21 illustrates a pool cleaning robot according to an embodiment of the invention.
Figure 22:
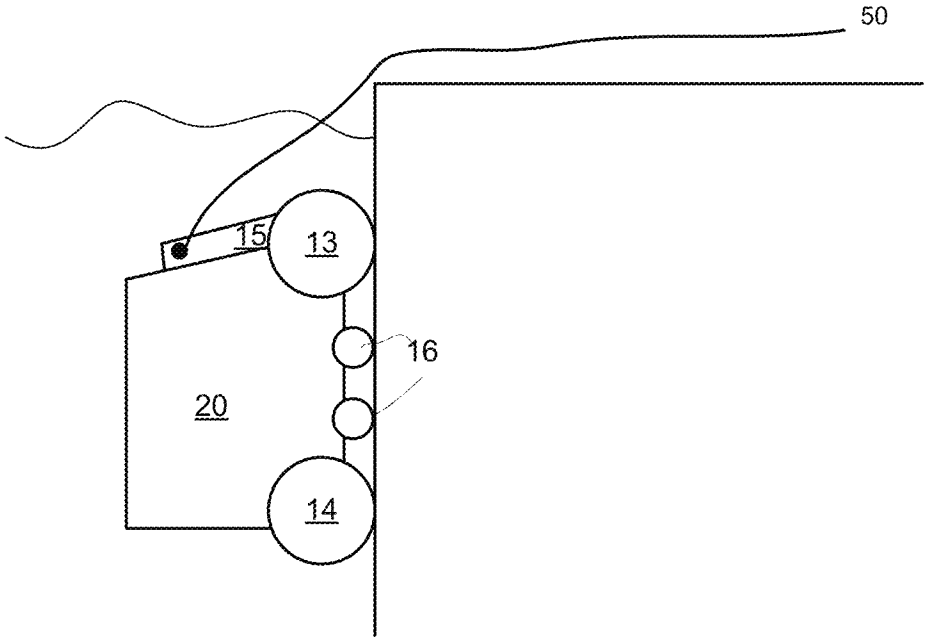
FIG. 22 illustrates a pool cleaning robot according to an embodiment of the invention.

During the exit process, and as especially illustrated in FIGS. 3, 10 and 16, the friction between the pool cleaning robot and the edge of the pool is decreased by having second interfacing elements such as wheels or guide wheels or auxiliary wheels 21, 22 and 23 that contact the edge of the pool during parts of the exit process.

The first interfacing elements are wheels (denoted 13 and 14 in FIG. 7) and/or tracks or any other interfacing elements that interface with the pool during the cleaning process.

An automatic, self-propelled pool cleaning robot may be governed by a controller (that may be positioned in a water proof box) in which a pre-set software or a manually overridden software set controls, amongst other, its cycle time. At the end of a cleaning cycle time, the pool cleaning robot stops its operation waiting for the end user to pull it out for service or for storage.

The reeling-in starts at a stage where the pool cleaning robot needs to exit the pool. The need may arise due to end of cycle, end of another pre-set period of time or reason such as a full filter bag that needs to be cleaned up or another service event.

According to an embodiment of the invention, as soon as a pre-set time event or any service event may occur, the cleaning program will end and the pool cleaning robot initiates a specific pool exit program protocol, a wired or wireless message is relayed to the cable reel/winch—wherever it may positioned or located—so that the reeling-out or extraction process may start.

The first stage will be to have the pool cleaning robot positioned near the wall in the vicinity where the cable reel/winch is located.

The pool cleaning robot may actively assist with the floor travelling and extraction process by means of its drive motors.

The pool cleaning robot may actively assist with the wall travelling and extraction process by means of its pump and drive motors.

The pool cleaning robot emits wired or wireless communications to the reel/winch constantly sending data regarding its position, bearing and speed of travel FIGS. 1-18 depict the pool cleaning robot as it is being reeled or pulled out (using a cable) while also assisting with the pool climbing to reach the waterline level.

In a preferred embodiment, the cable is tethered to the pool cleaning robot via its handle. Other embodiments may be possible.

During the pool exit and/or pool re entry phases, the pulling pressure exerted on the cable and handle may unfold and extend or retract the handle to a forward and/or upward or outward position whereby the distance between the cable and the pool cleaning robot housing is extended in order to increase the hoist span angle to be as wide as possible to enable smooth exiting and traversing of the sharp corner between the wall and the external environment of the pool.

The foldable/retractable handle 12 movement around the axis of rotation 28 of the handle, may be governed by a spring mechanism for deploying and folding the said handle that may be automatic (not shown). The handle of the pool cleaning robot will normally be in a folded or a "closed" position whereby the handle arms are fitted and/or locked into dedicated slots on the surface or within the housing of the pool cleaning robot in a way that does not interfere with normal cleaner operation (not shown). During the exiting phases from the pool, the handle will detach or release from the said slots and deploy to a retracted position or an "open" position.

Such a lock and release mechanism may be spring activated. Springs that force a movable element to be in a certain positions are known in the art (for example—a spring arrangement of a mouse trap). Thus, when the force and/or torque applied on the handle exceeds a predefined threshold the spring (or any other restraining element) is overcome and the handle moved to an open position.

The handle may be configured to move upwards and downwards—instead of rotatably moving. This is illustrated in FIGS. 19-22. The handle 15 may be extended upwards (in relation to the bottom of the housing). This handle may include telescopic bars and/or telescopic subsections or any other mechanism for elevating or lowering an anchor area—which is the area that is connected to the cable 50. The telescopic handle sections or sub sections may emerge or reenter from or to slots in the housing by means of springs, or other spring like mechanisms, from built-in pipes or tubes located within the housing (not shown).

It should be noted that the telescopic handle may include second interfacing elements such as wheels 21-23 of FIG. 7 and/or may have one, two or more than three interfacing elements located at the lower and front part of the telescopic handle. There may also be provided a combination of handles 12 and 15—a telescopic upper part and a lower part that may be parallel to or oriented to the telescopic upper part—with one or more second interfacing wheels.

It is noted that when the pool cleaning robot has first interfacing elements that are wheels 13 and 14—without a track then the bottom of the pool cleaning robot may include second interfacing elements 16.

The pool cleaning robot electrical power cord connects the docking station to the handle by means a sturdy mechanical attachment, the cable further winds through the internal hollow arms of the handle and eventually exits the handle to connect to the housing and supply electrical power to the pool cleaning robot motors and its control box.

Figure 26:
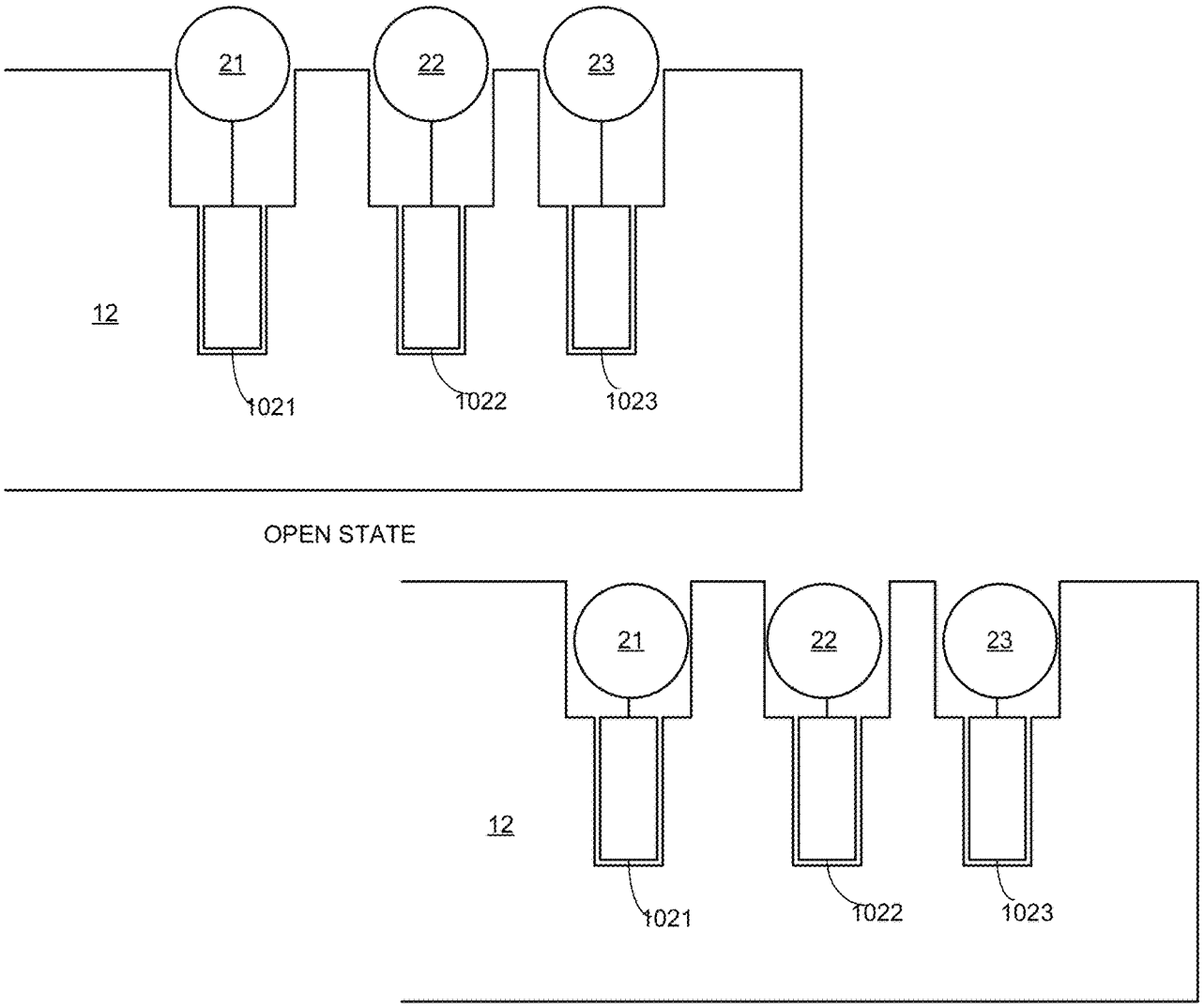
FIG. 26 illustrates a handle of a pool cleaning robot according to an embodiment of the invention.

During the exit phases, at least one auxiliary guide wheel, that is integrally attached to the handle and that may be oriented towards the pool floor or wall surfaces or outward from the bottom of the pool cleaning housing, may bump out to protrude and make contact with the said wall surfaces. FIG. 26 illustrates pistons 1021, 1022, 1023 located within handle 20 that may move the guide wheels 21, 22 and 23 between an open position in which the guide wheels extend out of handle and between closed position in which the guide wheels do not extend out of handle.

Said guide wheel may be a set of guide wheels that will form a set of multiple auxiliary foldable and retractable guide wheels to assist with the traversing, exiting and re-entry phases and processes of the pool cleaning robot. During the handle extraction or deployment to its fullest length, the guide wheels may simultaneously and progressively exit out from their slots. And vice versa, when folding the handle back into its folded position the guide wheels may simultaneously and progressively reenter into a folded position in the slots (not shown).

The guide wheels may have varying sizes and may be made of abrasion and chemical resistance natural or synthetic rubber such as polyurethane or silicone. Varying hardness (or softness) may be applied to different guide wheels.

Additional wheels and/or rollers may be located at the bottom of the housing in order to reduce friction and possible damage to either the pool surfaces/covers or the pool cleaning robot itself.

It should be noted that the pool cleaning robot may be filled with water and as soon as it reaches the waterline, water will incrementally evacuate the pool cleaning robot housing and it will become heavier as it moves out of water and gravity takes effect.

At a certain point in the exiting phases, the guide wheel will be forced against the corner meeting of the pool wall and external surface. This is the critical event where the reeling-in will utilize maximum energy to be able to cross the corner obstacle while pulling the entire weight of the pool cleaning robot.

After exiting, the pool cleaning robot may be further pulled to a parking spot on or near the docking station or caddy or be left to park near or by the pool side.

During external navigation to the said parking spot, the pool cleaning robot may assist with its driving system in order to speed up and facilitate the process.

A message may be wirelessly transmitted that the pool cleaning robot has exited the pool and is in parking position.

Due to obstacles that the pool cleaning robot may encounter, for example: pool cleaning robot is overweight whilst speed of reeling-out is too fast. The interactive communication between the pool cleaning robot and the reel/winch may actuate to implement corrective action measures for example by reducing exit speed or improving exit angle etc.

A torque sensor, torque transducer or a strain gage may be incorporated onto the motor/winch 90 on the rotating reel for measuring and recording the torque applied during the pulling of the pool cleaning robot. The controller 102 may receive and compare the data from one or more sensors (of the pool cleaning robot and/or of the docking station) with the preset thresholds for maximum and minimum torques allowed in the controlling of the exit or reentry process.

In other words, if the weight of the pool cleaning robot exceeds (for example 25 kgs) while exiting, then the controller may initiate an ON/OFF reeling mode whereby after each reeling and measuring the torque, the reeling will stop to allow for water evacuation from the vertically inclined pool cleaning robot. The stop may be replaced by slowing the speed of the exit process—slowing the rotation of the reel. The slowing may almost stop the progress of the pool cleaning robot. The control process may change the speed of rotation of the reel between more than two speeds during the exit process.

Any major obstacle encountered (for example a guide wheel stuck) may also signal for a temporary stop with back and forth torque testing or even to a reeling full stop sending the pool cleaning robot back into the pool. A low torque may be interpreted as a pool cleaning robot travelling horizontally so the reeling may set the rotation to a dead slow pre-set speed; and, vice versa when the pool cleaning robot travels on its own wheels/tracks to exit the docking station or the parking back into the pool. The pool cleaning robot travelling may signal the winch to incrementally release cable slack. At the pool edge, the winch will sense the increase weight while descending to the pool and resume an ON/OFF reeling mode until the pool cleaning robot has reentered the pool water and signals minimum torque levels.

The operation of returning or submerging the pool cleaning robot into the pool is performed in the reverse order whereby this will include a governing pool reentry or reintroduction program protocol at the winch/reel control box.

The said additional wheels and/or rollers that may be located at the bottom of the housing become particularly useful in a wheeled (non-tracked) pool cleaning robot embodiment.

The said additional wheels may be further driven by means of the on-board pool cleaning robot drive system.

For swimmers safety around the pool, the docking station/winch and/or pool cleaning robot may be equipped with a buzzer and flashing LED to draw attention that a reeling maneuver is underway.

Figure 23:
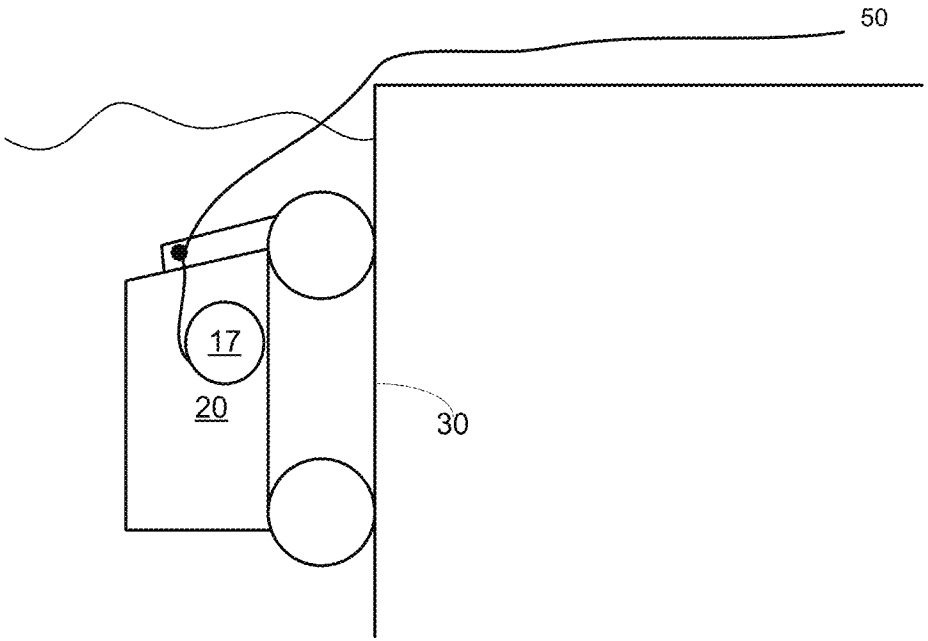
FIG. 23 illustrates a pool cleaning robot according to an embodiment of the invention.

FIG. 23 illustrates the winch 17 may be included in the pool cleaning robot. The winch of the pool cleaning robot may replace the winch of the external system. The pool cleaning robot may or may not include the handle. Cable 50 is connected between the pool cleaning robot and the external system—it may be fixed to a frame of the external system that may also include an electrical power supply pack. The winch may be controlled by the controller 102 of the pool cleaning robot or by the controller of the system.

Figure 24:
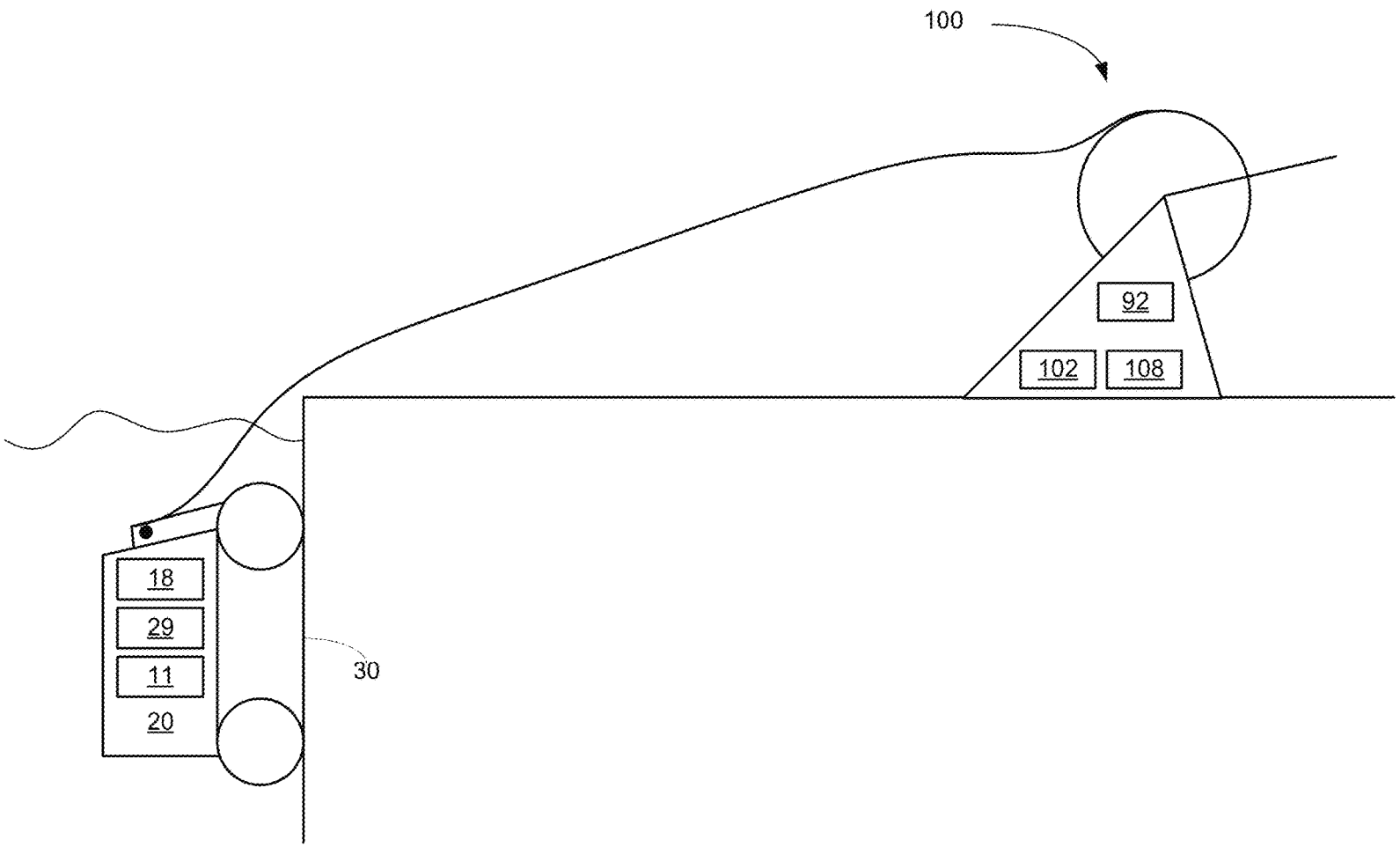
FIG. 24 illustrates a docking station and a pool cleaning robot according to an embodiment of the invention.

The pool cleaning robot and the external system may communicate with each other in order to send commands, status indications, sensor readings and the like. FIG. 24 illustrates pool cleaning robot 20 as including a communication unit 18 and the external system 100 as including a communication unit 108. The communication can be wireless and/or wired communication. Pool cleaning robot 20 may include one or more of the elements illustrated in the previous figures—such as controller 29 and/or sensor 11.

External system 100 may include one or more of the elements illustrated in the previous figures—such as controller 102 and/or sensor 92.

Figure 25:
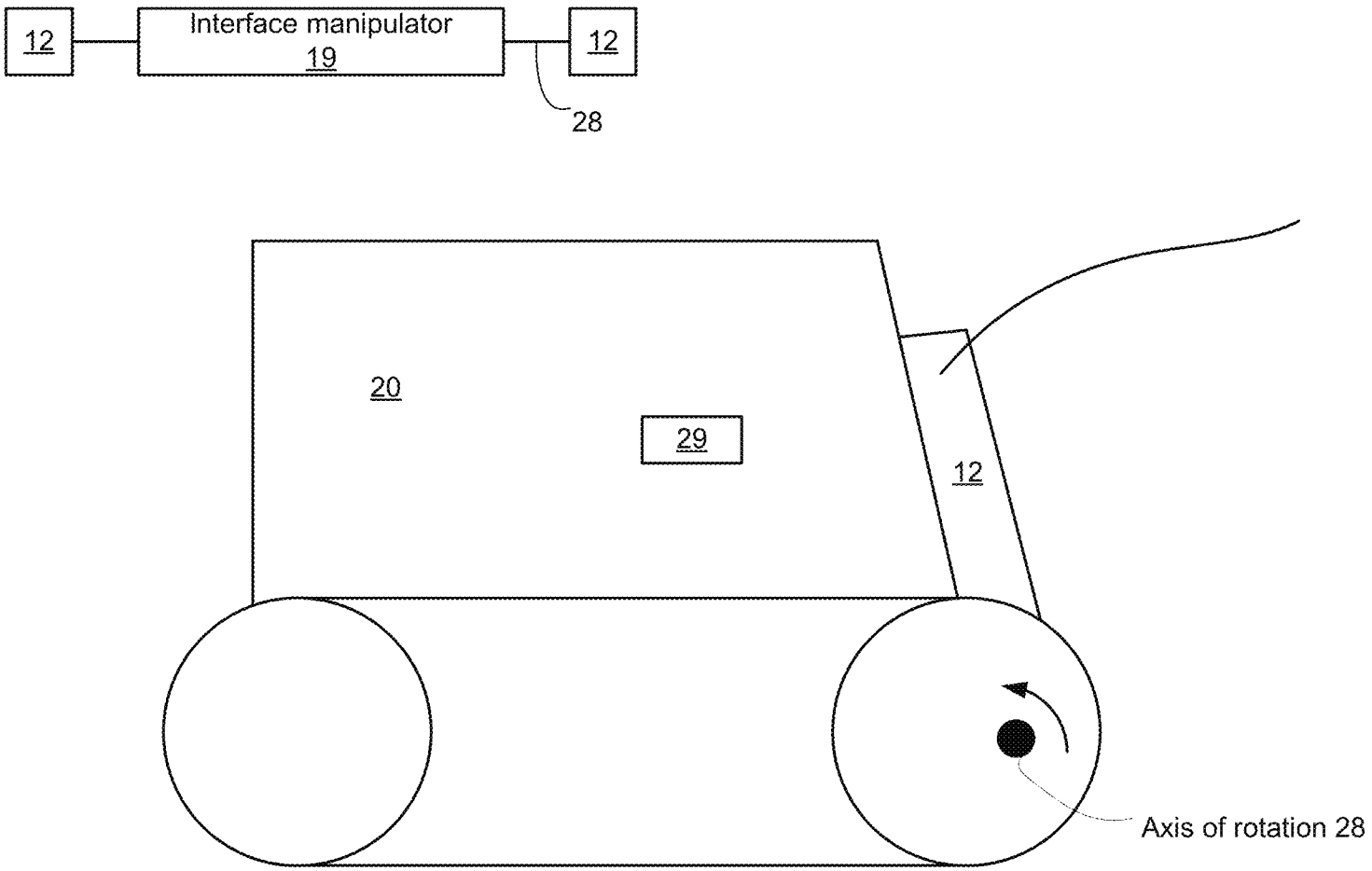
FIG. 25 illustrates a pool cleaning robot according to an embodiment of the invention.

FIG. 25 illustrates a pool cleaning robot 20 that includes an interface manipulator 19 for rotating handle 12 about a rotation axis 28. The interface manipulator 19 may be a motor that may be controlled by a controller 29.

Figure 27:
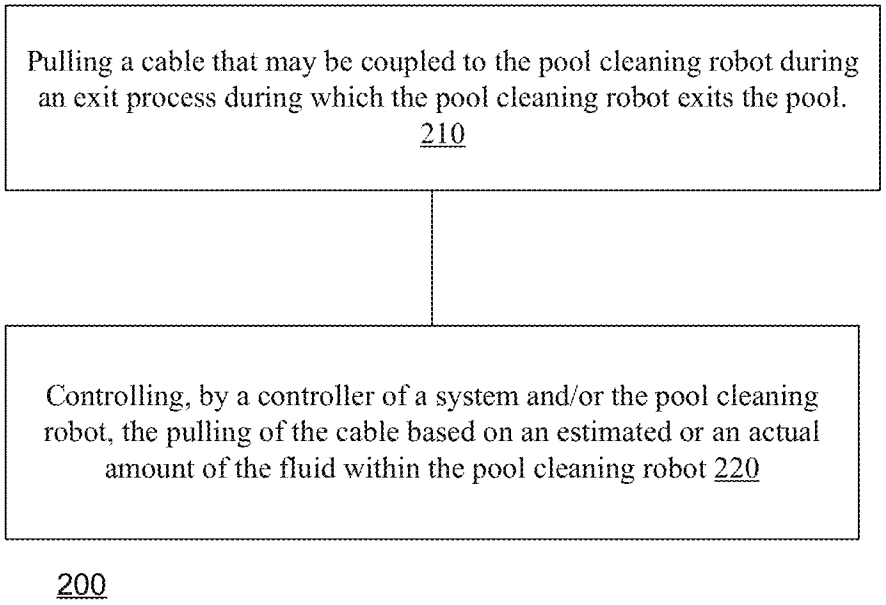
FIG. 27 illustrates a method according to an embodiment of the invention.

FIG. 27 illustrates method 200 according to an embodiment of the invention.

Method 200 may include step 210 of pulling a cable that may be coupled to the pool cleaning robot during an exit process during which the pool cleaning robot exits the pool.

Step 210 may be followed by step 220 of controlling, by a controller of a system and/or the pool cleaning robot, the pulling of the cable based on an estimated or an actual amount of the fluid within the pool cleaning robot.

The system may be positioned at a predefined distance (for example between 30 centimeters and 2 meters or more) from an edge of the pool. No part of the system may be directly above the water of the pool.

The pulling may be executed by a motor and a reel; and wherein a part of the reel may be positioned below the edge of the pool. See, for example, system 100 of FIGS. 7-18.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one as or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements the mere fact that certain measures are recited in mutually different claims does not indicate that a combination of these measures cannot be used to advantage.

Any system, apparatus or device referred to this patent application includes at least one hardware component.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A pool cleaning robot for cleaning a pool, comprising: a housing; a first interfacing element is constructed and arranged to interface between the pool cleaning robot and a bottom of a pool while the pool cleaning robot is horizontal and cleans the bottom of the pool; an intermediate element; one or more second interfacing elements that are constructed and arranged to reduce a friction between an edge of the pool and the pool cleaning robot during at least a portion of an exit process in which the pool cleaning robot exits the pool and the pool cleaning robot is neither vertical nor horizontal; wherein the one or more second interfacing elements comprise at least one radially symmetrical rotating element; wherein the one or more second interfacing elements comprise one or more radially symmetrical rotating elements that are coupled to a front part of the intermediate element; wherein the intermediate element is constructed and arranged to move between a first position to a second position thereby changing a spatial relationship between the housing and the radially symmetrical rotating element; and wherein the one or more radially symmetrical rotating elements comprise multiple radially symmetrical rotating elements that form a sequence of radially symmetrical rotating elements.

2. The pool cleaning robot according to claim 1, wherein a given second interface of the one or more second interfacing elements is constructed and arranged not to contact the bottom of the pool when the pool cleaning robot cleans the bottom of the pool.

3. A pool cleaning robot for cleaning a pool, comprising: a housing; a first interfacing element is constructed and arranged to interface between the pool cleaning robot and a bottom of a pool while the pool cleaning robot is horizontal and cleans the bottom of the pool; an intermediate element; wherein one or more second interfacing elements that are constructed and arranged to reduce a friction between an edge of the pool and the pool cleaning robot during at least a portion of an exit process in which the pool cleaning robot exits the pool and the pool cleaning robot is neither vertical and neither horizontal; wherein the one or more second interfacing elements comprise at least one radially symmetrical rotating element; wherein the one or more second interfacing elements comprise one or more radially symmetrical rotating elements that are coupled to a front part of the intermediate element; wherein the intermediate element is constructed and arranged to move between a first position to a second position thereby changing a spatial relationship between the housing and the radially symmetrical rotating element; and wherein the one or more radially symmetrical rotating elements comprise multiple radially symmetrical rotating elements that are positioned at different heights.

4. The pool cleaning robot according to claim 3, comprising an interface manipulator that is constructed and arranged to move the intermediate element between the first position to the second position.

5. The pool cleaning robot according to claim 3, wherein the intermediate element is rotatably coupled to the housing.

6. The pool cleaning robot according to claim 3, wherein the intermediate element is a handle that has an axis of rotation that virtually intersects with a front lower part of the housing.

7. The pool cleaning robot according to claim 3, wherein the one or more radially symmetrical rotating elements are constructed and arranged to move between an inner position to an external position thereby changing a spatial relationship between the one or more radially symmetrical rotating elements and the housing, wherein when positioned in the external position, during the portion of the exit process, the one or more radially symmetrical rotating element protrudes from the intermediate element.

8. The pool cleaning robot according to claim 7 wherein the one or more radially symmetrical rotating elements are constructed and arranged to be positioned at the inner position in which the one or more radially symmetrical rotating elements do not protrude from the intermediate element when the pool cleaning robot cleans the pool.

9. The pool cleaning robot according to claim 3, comprising a sensor and a controller; wherein the controller is constructed and arranged to trigger a movement of the intermediate element between the first position and the second position based on signals sent from the sensor.

10. The pool cleaning robot according to claim 9, wherein the sensor is a height sensor.

11. The pool cleaning robot according to claim 9, wherein the sensor is an out of water sensor that is constructed and arranged to sense that at least a portion of the pool cleaning robot exits a water of the pool.

12. The pool cleaning robot according to claim 3, comprising a controller; wherein the controller is constructed and arranged to trigger a movement of the intermediate element between the first position and the second position based on signals sent from an external system comprising an external sensor that is constructed and arranged to assist in an extraction of the pool cleaning robot from the pool.

13. The pool cleaning robot according to claim 3, wherein intermediate element is mechanically coupled to an external system that is constructed and arranged to assist in an extraction of the pool cleaning robot from the pool; wherein the pool cleaning robot is constructed and arranged to perform the movement of the intermediate element between the first position and the second position based on a command from the system.

14. The pool cleaning robot according to claim 12, wherein intermediate element is mechanically coupled to the external system via a cable; and wherein the movement of the intermediate element between the first position and the second position is responsive to a tension of the cable.

15. The pool cleaning robot according to claim 1, comprising a motor that is constructed and arranged to assist in propelling the pool cleaning robot during the exit process.

16. The pool cleaning robot according to claim 1, comprising a winch that is mechanically coupled to the housing and is constructed and arranged to propel the pool cleaning robot during the exit process.

17. The pool cleaning robot according to claim 1, comprising: at least one aperture for draining fluid from the pool cleaning robot during the exit process; and a controller that is constructed and arranged to affect a timing of at least one phase of the exit process based upon an estimated or an actual amount of the fluid within the pool cleaning robot.

18. The pool cleaning robot according to claim 1, comprising: at least one aperture for draining fluid from the pool cleaning robot during the exit process; and a controller that is constructed and arranged to affect a timing of at least one phase of the exit process based upon an aggregate weight of the pool cleaning robot and the fluid within the pool cleaning robot.

19. The pool cleaning robot according to claim 1, comprising a controller that is constructed and arranged to prevent a center of the pool cleaning robot from passing an edge of the pool before an amount of fluid that resides in the pool cleaning robot is below a predefined threshold.

20. The pool cleaning robot according to claim 1, wherein the one or more second interfacing elements are constructed and arranged to reduce a friction between an edge of the pool and the pool cleaning robot during the portion of the exit process.

21. The pool cleaning robot according to claim 1, wherein at least one of the one or more second interfacing elements is coupled to a bottom of the housing.

22. The pool cleaning robot according to claim 1, comprising a drive system that comprises a main portion and an auxiliary portion; wherein the auxiliary portion is arranged to move the pool cleaning robot during the portion of the exit process; and wherein the main portion is arranged to move the pool cleaning robot when the robot cleans the pool.

* * * * *